US011174777B2

(12) United States Patent
Muto et al.

(10) Patent No.: US 11,174,777 B2
(45) Date of Patent: Nov. 16, 2021

(54) ABNORMALITY DETECTION SYSTEM OF ENGINE COOLING WATER RECIRCULATION SYSTEM

(71) Applicant: TOYOTA JIDOSHA KABUSHIKI KAISHA, Toyota (JP)

(72) Inventors: Harufumi Muto, Miyoshi (JP); Akihiro Katayama, Toyota (JP); Yosuke Hashimoto, Nagakute (JP); Junji Hyodo, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 53 days.

(21) Appl. No.: 16/752,739

(22) Filed: Jan. 27, 2020

(65) Prior Publication Data

US 2020/0300156 A1 Sep. 24, 2020

(30) Foreign Application Priority Data

Mar. 19, 2019 (JP) ..... JP2019-051055

(51) Int. Cl.
*F01P 11/16* (2006.01)
*F01P 7/16* (2006.01)
*F01P 7/14* (2006.01)

(52) U.S. Cl.
CPC ..... *F01P 11/16* (2013.01); *F01P 7/167* (2013.01); *F01P 2007/146* (2013.01); *F01P 2023/08* (2013.01); *F01P 2025/32* (2013.01); *F01P 2025/66* (2013.01); *F01P 2060/08* (2013.01)

(58) Field of Classification Search
CPC .. F01P 2023/08; F01P 2007/146; F01P 7/167; F01P 11/16
See application file for complete search history.

(56) References Cited

U.S. PATENT DOCUMENTS

2011/0061405 A1* 3/2011 Watanabe ..... B60H 1/3227 62/61
2013/0253758 A1 9/2013 Nishi
2018/0361846 A1* 12/2018 Dudar ..... B60K 11/085

FOREIGN PATENT DOCUMENTS

JP 2012-127324 A 7/2012
JP 2014-95300 A 5/2014

* cited by examiner

*Primary Examiner* — Kevin A Lathers
(74) *Attorney, Agent, or Firm* — Oblon, McClelland, Maier & Neustadt, L.L.P.

(57) ABSTRACT

To estimate an engine cooling water temperature, four learned neural networks (150A, 150B, 150C, and 150D) are stored, in which weights are learned for the four states of whether the grille shutter (50) is opened and whether air blown by the blower (63) circulates through the air-conditioning use heater (65). The engine cooling water temperature is estimated using any one of the learned neural networks selected from among the four learned neural networks (150A, 150B, 150C, and 150D). An abnormality of the engine cooling water recirculation system is detected based on the estimated value of the engine cooling water temperature.

6 Claims, 24 Drawing Sheets

FIG. 15

| | | INPUT PARAMETERS | ALTERNATIVE INPUT PARAMETERS |
|---|---|---|---|
| ESSENTIAL | | ENGINE COOLING WATER TEMPERATURE | |
| | HEAT GENERATING FACTORS | AMOUNT OF INTAKE AIR | |
| | | AMOUNT OF FUEL INJECTION | |
| | HEAT RADIATING FACTORS | OUTSIDE AIR TEMPERATURE | |
| | | VEHICLE SPEED | AMOUNT OF FLOW OF ELECTRIC FAN |
| AUXILIARY | HEAT GENERATING FACTORS | IGNITION TIMING | |
| | | EGR RATE | |
| | | EXHAUST VALVE OPENING TIMING | |
| | HEAT RADIATING FACTORS | ENGINE SPEED | AMOUNT OF FLOW OF ELECTRIC WATER PUMP |

FIG. 16

| No. | $x_1$ | $x_2$ | • • • • • • • • • • • | $x_{n-1}$ | $x_n$ | $y_t$ |
|---|---|---|---|---|---|---|
| 1 | $x_{11}$ | $x_{21}$ | • • • • • • • • • • • | $x_{n-11}$ | $x_{n1}$ | $y_{t1}$ |
| 2 | $x_{12}$ | $x_{22}$ | • • • • • • • • • • • | $x_{n-12}$ | $x_{n2}$ | $y_{t2}$ |
| • | • | • | • | • | • | • |
| m−1 | $x_{1m-1}$ | $x_{2m-1}$ | • • • • • • • • • • • | $x_{n-1m-1}$ | $x_{nm-1}$ | $y_{tm-1}$ |
| m | $x_{1m}$ | $x_{2m}$ | • • • • • • • • • • • | $x_{n-1m}$ | $x_{nm}$ | $y_{tm}$ |

ABNORMALITY DETECTION SYSTEM OF ENGINE COOLING WATER RECIRCULATION SYSTEM

FIELD

The present invention relates to an abnormality detection system of an engine cooling water recirculation system.

BACKGROUND

Known in the art is an internal combustion engine predicting changes in engine cooling water temperature after engine startup from an engine speed, amount of fuel injection, outside air temperature, vehicle speed, and opening degree of an EGR control valve and detecting an abnormality in operation of a thermostat adjusting cooling water based on this predicted water temperature (for example, see Japanese Unexamined Patent Publication No. 2012-127324). In this case, if learning weights of a neural network using the engine speed, amount of fuel injection, outside air temperature, vehicle speed, and opening degree of an EGR control valve as input parameters of the neural network and using a measured value of the engine cooling water temperature as training data, it is possible to obtain a predicted value of the engine cooling water temperature by a high precision.

SUMMARY OF INVENTION

In this regard, in the case of provision of a grille shutter able to adjust a flow of running air flowing from outside of a vehicle to around an engine body and in the case of provision of an air-conditioning device having an air-conditioning use heater to which engine cooling water is supplied and a blower for blowing air to the air-conditioning use heater so as to make heated air flow out from the air-conditioning use heater, the engine cooling water temperature greatly fluctuates according to the operating state of the grille shutter and the operating state of the air-conditioning device.

If in this way the engine cooling water temperature greatly fluctuates, even if adding an operating state of the grille shutter and an operating state of the air-conditioning device to the input parameters of the neural network, it is difficult to learn weights of a neural network so as to be able to accurately predict the engine cooling water temperature for changes in the operating state of the grille shutter or the operating state of the air-conditioning device. Therefore, there is the problem that it is not possible to precisely predict the changes in the engine cooling water temperature just by adding the operating state of the grille shutter and the operating state of the blower to the input parameters of a neural network.

To solve the above problem, according to the present invention, there is provided an abnormality detection system of an engine cooling water recirculation system comprising:

a grille shutter able to adjust a flow of running air flowing in from outside of a vehicle to surroundings of an engine body, an air-conditioning device having an air-conditioning use heater to which engine cooling water is supplied and a blower blowing air to the air-conditioning use heater to make heated air flow out from the air-conditioning use heater, and an engine cooling water recirculation system, the above mentioned engine cooling water recirculation system comprising a water pump, a main cooling water recirculation passage by which cooling water flowing out from the water pump returns to the water pump through a water jacket and radiator in the engine body, a sub cooling water recirculation passage by which cooling water flowing out from the water pump returns to the water pump through the air-conditioning use heater, a bypass passage branched from the main cooling water recirculation passage and bypassing the radiator, and a thermostat adjusting a flow of cooling water returning from the main cooling water recirculation passage and bypass passage to the water pump, an abnormality in the engine cooling water recirculation system being detected based on an engine cooling water temperature, wherein four learned neural networks are stored, which are obtained by using at least five parameters comprised of an engine cooling water temperature at the time of engine start, an amount of air taken into the engine, an amount of fuel injected into the engine, an outside air temperature, and a vehicle speed as input parameters of the neural networks and using a measured value of the engine cooling water temperature as training data to learn weights for four states comprising a state where the grille shutter is closed and an air blown by the blower does not circulate through the air-conditioning use heater, a state where the grille shutter is opened and the air blown by the blower does not circulate through the air-conditioning use heater, a state where the grille shutter is closed and the air blown by the blower circulates through the air-conditioning use heater, and a state where the grille shutter is opened and the air blown by the blower circulates through the air-conditioning use heater, the engine cooling water temperature is estimated from among the above mentioned five parameters using any one of the learned neural networks corresponding to a current state of the grille shutter and circulating state of the air blown by the blower in the air-conditioning use heater among the four learned neural networks, and an abnormality of the engine cooling water recirculation system is detected based on an estimated value of the engine cooling water temperature.

By using four learned neural networks learning weights for the four states comprising a state where the grille shutter is closed and the air blown by the blower does not circulate through the air-conditioning use heater, a state where the grille shutter is opened and the air blown by the blower does not circulate through the air-conditioning use heater, a state where the grille shutter is closed and the air blown by the blower circulates through the air-conditioning use heater, and a state where the grille shutter is opened and the air blown by the blower circulates through the air-conditioning use heater, it becomes possible to predict the engine cooling water temperature with a high precision.

BRIEF DESCRIPTION OF DRAWINGS

FIG. 15 is a view showing a list of input parameters.

FIG. 16 is a view showing a training data set.

DESCRIPTION OF EMBODIMENTS

Overall Configuration of Internal Combustion Engine

Figure 1:
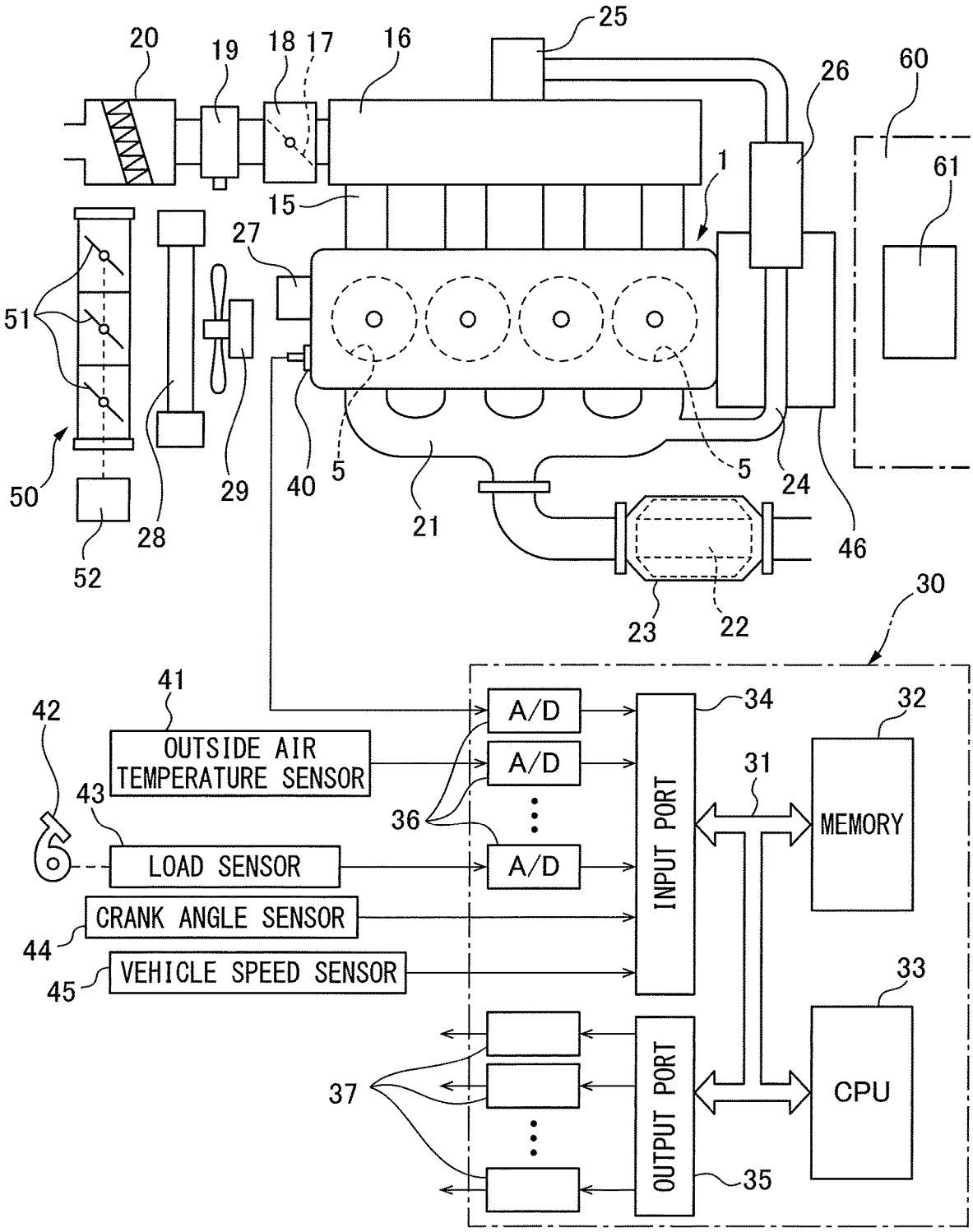
FIG. 1 is an overall view of the surroundings of an internal combustion engine.
Figure 2:
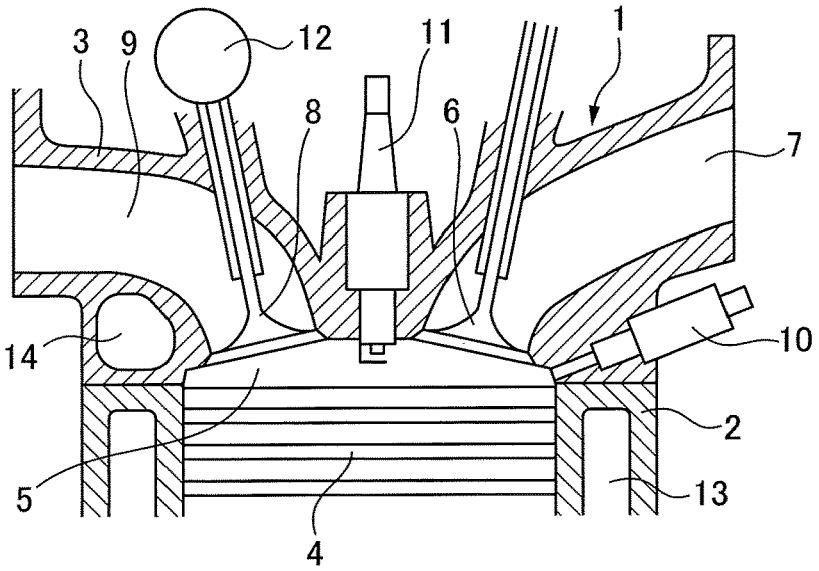
FIG. 2 is a side cross-sectional view of the internal combustion engine shown in FIG. 1.

FIG. 1 shows an overall view of the surroundings of an internal combustion engine, while FIG. 2 shows a side cross-sectional view of an internal combustion engine. If referring to FIG. 2, 1 indicates an engine body, 2 a cylinder block, 3 a cylinder head, 4 a piston reciprocating inside the cylinder block 2, 5 a combustion chamber, 6 an intake valve, 7 an intake port, 8 an exhaust valve, 9 an exhaust port, 10 a fuel injector for supplying the combustion chamber 5 with fuel, for example, gasoline, 11 a spark plug arranged inside the combustion chamber 5, and 12 a variable valve timing mechanism for controlling the opening timing of the exhaust valve 8. As shown in FIG. 2, inside the cylinder block 2, a water jacket 13 is formed. Inside the cylinder head 3, a water jacket 14 is formed.

Referring to FIG. 1 and FIG. 2, the intake ports 7 are connected to the surge tank 16 through respectively corresponding intake runners 15, while the surge tank 16 is connected to an air cleaner 20 through a throttle body 18 having a built-in throttle valve 17 and an intake air amount detector 19. On the other hand, the exhaust ports 9 are connected through an exhaust manifold 21 to an exhaust heat collector 23 having a built-in exhaust purification use catalyst 22. Further, the exhaust manifold 21 is connected to the surge tank 16 through an exhaust gas recirculation (below, referred to as the "EGR") passage 24 and EGR control valve 25. Inside the EGR passage 24, an EGR cooler 26 is arranged for cooling the EGR gas. Note that, in FIG. 1, 27 shows a water pump driven by the engine, while 28 shows a radiator and 29 shows a cooling use electric fan of the radiator 28.

On the other hand, in FIG. 1, 30 shows an electronic control unit for controlling the operation of the engine. As shown in FIG. 1, the electronic control unit 30 is comprised of a digital computer provided with a storage device 32, that is, a memory 32, a CPU (microprocessor) 33, input port 34, and output port 35, which are connected with each other by a bidirectional bus 31. At the engine body 1, a water temperature sensor 40 for detecting the temperature of the cooling water is attached. An output signal of the intake air detector 19, an output signal of the water temperature sensor 40, and an output signal of an outside air temperature sensor 41 for detecting an outside air temperature are input to the input port 34 through respectively the corresponding AD converters 36. Further, at an accelerator pedal 42, a load sensor 43 generating an output voltage proportional to an amount of depression of the accelerator pedal 42 is connected. The output voltage of the load sensor 43 is input to the input port 34 through the corresponding AD converter 36. Furthermore, at the input port 34, a crank angle sensor 44 generating an output pulse every time the crankshaft rotates by for example 30° is connected. Inside the CPU 33, the engine speed is calculated based on the output signal of the crank angle sensor 44. Furthermore, at the input port 34, a vehicle speed sensor 45 generating an output pulse proportional to the vehicle speed is connected.

On the other hand, the output port 35 is connected through corresponding drive circuits 37 to the fuel injectors 10 and spark plugs 11 of the cylinders, the actuator of the throttle valve 17, the EGR control valve 25, and the electric fan 29. Further, the internal combustion engine shown in FIG. 1 is a hybrid engine, and a drive control mechanism 46 provided with a drive motor, a power generating motor, etc. is attached to the engine body 1. The drive control of the drive motor and the power generation control of the power generating motor are performed by the electronic control unit 30. Note that, in an embodiment according to the present invention, if an instruction for starting up the engine is issued at the electronic control unit 30, the engine is started up by the drive motor inside the drive control mechanism 46.

Figure 3:
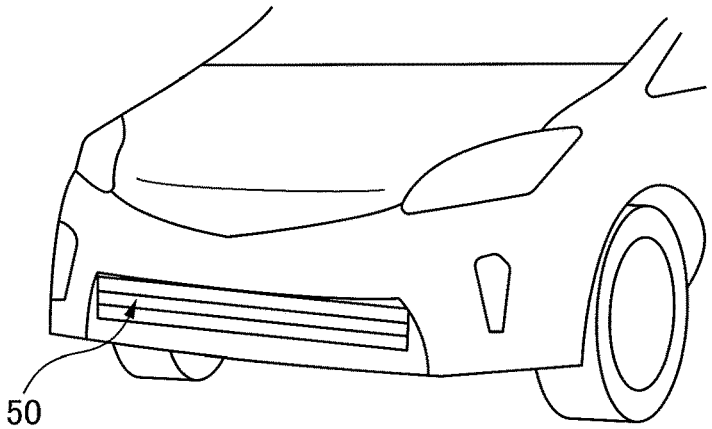
FIG. 3 is a perspective view of the front face of a vehicle.

On the other hand, as shown in FIG. 1, in front of the radiator 28 in the direction of advance of the vehicle, a grille shutter 50 able to adjust the flow of running air flowing from outside of the vehicle to around the engine body 1 is arranged. This grille shutter 50, as shown in FIG. 3, is arranged on the front face of the vehicle. In the example shown in FIG. 1, this grille shutter 50 is comprised of a plurality of butterfly valve shaped shutters 51 arranged in alongside each other. These shutters 51 are driven by an actuator 52. This grille shutter 50 is usually closed at the time of engine start and at the time of warm-up operation after engine startup, but sometimes is opened. This actuator 52 is controlled based on the output signal of the electronic control unit 30.

Figure 4:
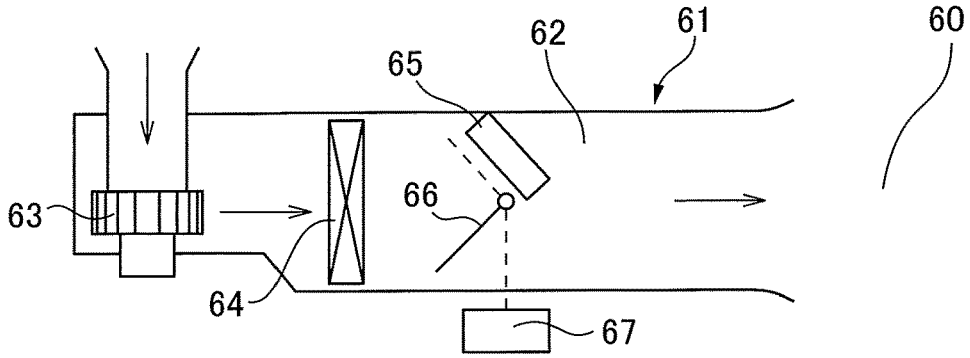
FIG. 4 is a side view of a schematically illustrated air-conditioning device.

Further, as shown in FIG. 1, an air-conditioning device 61 is arranged inside a passenger compartment 60 of the vehicle. As shown in FIG. 4, this air-conditioning device 61 is provided with an air circulation duct 61, a blower 63 driven by an electric motor, an evaporator 64 of a cooling device, an air-conditioning use heater 65 to which cooling water is supplied, and a door 66 driven by an actuator 67. This door 66 is made to switch between a position covering the front of the air-conditioning use heater 65 as shown by the broken line and a position opening the front of the air-conditioning use heater 65 as shown by the solid line. Schematically explaining the operation of this air-conditioning device 61, when heating or cooling the inside of the passenger compartment 60, the blower 63 is driven to rotate and the air blown from the blower 63 is sent into the evaporator 64. In this case, if the front of the air-conditioning use heater 65 is covered by the door 66 and refrigerant is supplied to the inside of the evaporator 64, the inside of the passenger compartment 60 is cooled. On the other hand, if the door 66 opens the front of the air-conditioning use heater 65 and refrigerant is stopped being supplied to the inside of the evaporator 64, the inside of the passenger compartment 60 is heated. Further, when heating or cooling and dehumidifying the inside of the passenger compartment 60, the door 66 opens the front of the air-conditioning use heater 65 and refrigerant is supplied to the inside of the evaporator 64.

This air-conditioning device 61 is controlled by an electronic control unit provided inside the air-conditioning device 61 in accordance with a request of a rider. In this regard, in this case, what has an effect on the cooling water temperature of the engine is the magnitude of the heat radiating action at the air-conditioning use heater 65 to which the cooling water is supplied. That is, when the blower 63 is stopped or when, as shown in FIG. 4 by the broken line, the front of the air-conditioning use heater 65 is covered by the door 66, there is almost no heat radiating action at the air-conditioning use heater 65. As opposed to this, when the blower 63 is operating and the door 66 opens the front of the air-conditioning use heater 65, the heat radiating action at the air-conditioning use heater 65 becomes larger. In the present Specification, in this way, the state where the heat radiating action at the air-conditioning use heater 65 becomes larger will be referred to as "the state where the air blown by the blower 63 is circulating through the air-conditioning use heater 65". As opposed to this, the state where there is almost no heat radiating action at the air-conditioning use heater 65 will be referred to as "the state where the air blown by the blower 63 is not circulating through the air-conditioning use heater 65". In this case, whether the state is one where the air blown by the blower 63 is circulating through the air-conditioning use heater 65 can be judged from a control signal of the electronic control unit provided inside the air-conditioning device 61.

Figure 5:
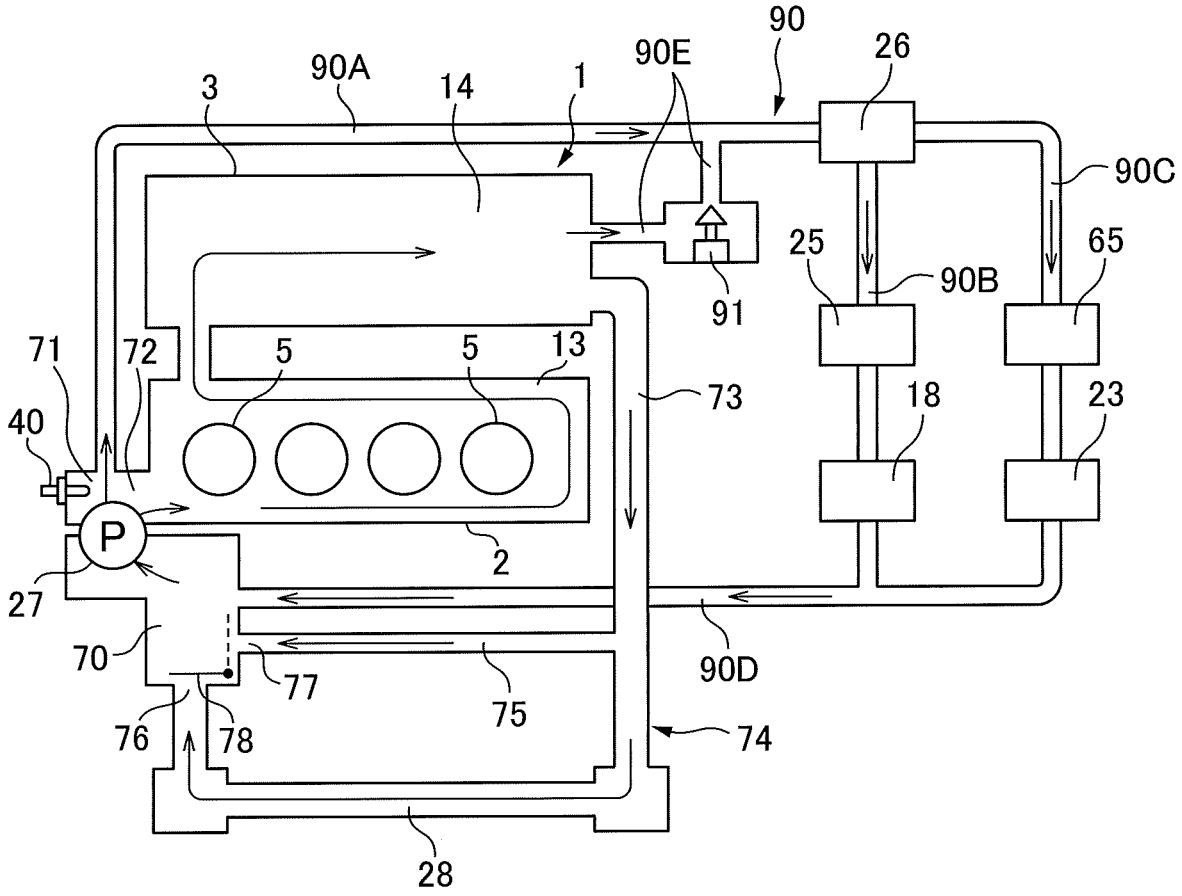
FIG. 5 is an overall view of an engine cooling water recirculation system.

Next, referring to FIG. 5, the engine cooling water recirculation system will be explained. Referring to FIG. 5, FIG. 5 schematically shows the engine body 1, cylinder block 2, cylinder head 3, combustion chamber 5, water jackets 13 and 14, throttle body 18, exhaust heat collector 23, EGR control valve 25, EGR cooler 26, water pump 27, radiator 28, water temperature sensor 40, and air-conditioning use heater 65 described in FIG. 1, FIG. 2, and FIG. 4. On the other hand, in FIG. 5, a cooling water return chamber 70 and a cooling water supply chamber 71 are schematically shown at the two sides of the water pump 27, and the cooling water inside of the cooling water return chamber 70 is supplied by the water pump 27 to the inside of the cooling water supply chamber 71.

The cooling water supplied by the water pump 27 to the inside of the cooling water supply chamber 71 flows from an inlet 72 of the water jackets 13 and 14 to the insides of the water jackets 13 and 14. Then, this cooling water passes through the cooling water passage 73 and radiator 28 and is returned to the cooling water return chamber 70. At this time, the heat which the cooling water absorbs in the water jackets 13 and 14 is dispersed at the radiator 28. In the embodiment according to the present invention, the cooling water passage by which the cooling water flowing out from the water pump 27 in this way flows through the water jackets 13 and 14, the cooling water passage 73, and the radiator 28 inside the engine body 1 and returns to the water pump 27 will be referred as the "main cooling water recirculation passage 74". After the engine finishes being warmed up, the cooling water circulates through the inside of this main cooling water recirculation passage 74 in this way.

Figure 6A:
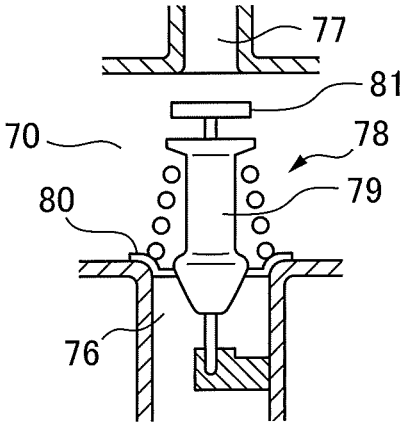
FIG. 6A and FIG. 6B are views for explaining operation of a thermostat.
Figure 6B:
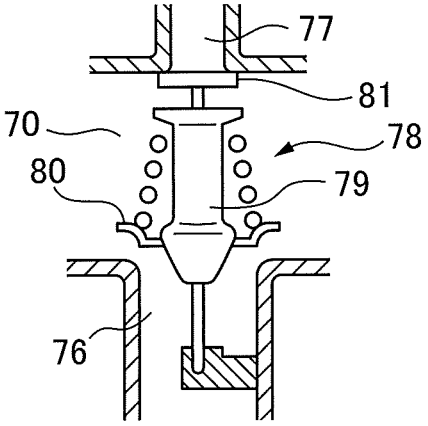

On the other hand, in the engine cooling water recirculation system shown in FIG. 5, a bypass passage 75 branched from the main cooling water recirculation passage 74 and bypassing the radiator 28, that is, a bypass passage 75 connecting the cooling water passage 73 and cooling water return chamber 70, is provided. Further, as shown in FIG. 5, inside the cooling water return chamber 70, a thermostat 78 able to close either of the opening part 76 of the main cooling water recirculation passage 74 to the inside of the cooling water return chamber 70 and the opening part 77 of the bypass passage 75 to the inside of the cooling water return chamber 70 is schematically shown. One example of this thermostat 78 is shown in FIG. 6A and FIG. 6B. In the example shown in FIG. 6A and FIG. 6B, the thermostat 78 is provided with a main body part 79 in which wax is filled, a valve element 80 able to close the opening part 76 of the main cooling water recirculation passage 74, and a valve element 81 able to close the opening part 77 of the bypass passage 75.

When the cooling water temperature around the main body part 79 is low, as shown in FIG. 5 by the solid line and as shown in FIG. 6A, the valve element 80 of the thermostat 78 closes the opening part 76 of the main cooling water recirculation passage 74 and the valve element 81 of the thermostat 78 opens the opening part 77 of the bypass passage 75. At this time, the cooling water supplied to the water jackets 13 and 14 is returned through the bypass passage 75 to the water pump 27 without passing through the radiator 28. Therefore, at this time, the warm-up action of the engine body 1 is promoted. As opposed to this, if the cooling water temperature around the main body part 79 becomes higher, the wax inside the main body part 79 expands. As a result, as shown in FIG. 5 by the broken line and as shown in FIG. 6B, the valve element 80 of the thermostat 78 opens the opening part 76 of the main cooling water recirculation passage 74 and the valve element 81 of the thermostat 78 closes the opening part 77 of the bypass passage 75. At this time, the cooling water sent into the water jackets 13 and 14 is returned through the radiator 28 to the water pump 27. Therefore, at this time, the usual cooling action of the engine body 1 is performed.

Figure 7:
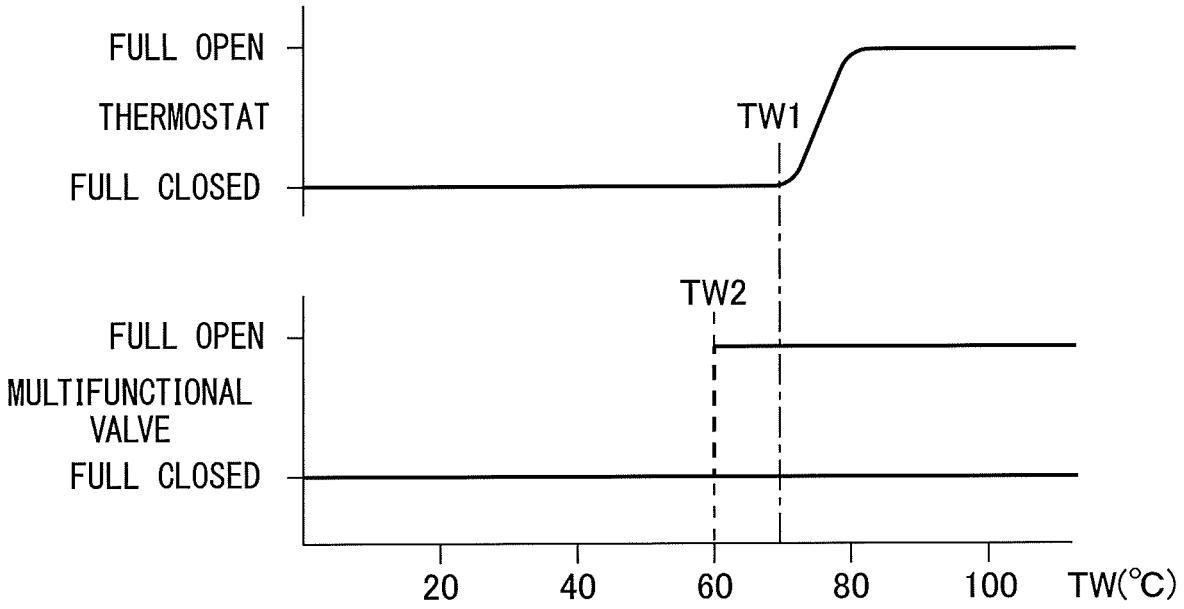
FIG. 7 is a view for explaining operations of a thermostat and a multifunctional valve.

FIG. 7 shows the relationship between the opening degree of the valve element 80 of the thermostat 78 and a cooling water temperature TW around the main body part 79 of the thermostat 78. As shown in FIG. 7, when the cooling water temperature TW is lower than a set water temperature TW1, the valve element 80 of the thermostat 78 fully closes the opening part 76 of the main cooling water recirculation passage 74. If the cooling water temperature TW becomes higher than the set water temperature TW1, the valve element 80 of the thermostat 78 starts to open the opening part 76 of the main cooling water recirculation passage 74. Note that, in the example shown in FIG. 7, the set water temperature TW1 is made 70° C.

Again returning to FIG. 5, the engine cooling water recirculation system is provided with a sub cooling water recirculation passage 90 by which cooling water flowing out from the water pump 27 circulates, then returns to the water pump 27. As will be understood from FIG. 5, this sub cooling water recirculation passage 90 is comprised of a sub cooling water recirculation passage part 90A extending from the cooling water supply chamber 71 to the EGR cooler 26, sub cooling water recirculation passage parts 90B and 90C branched at the EGR cooler 26, and a sub cooling water recirculation passage part 90D extending from these sub cooling water recirculation passage parts 90B and 90C to the cooling water return chamber 70. The throttle body 18 and EGR control valve 25 are arranged in the sub cooling water recirculation passage part 90B, while the exhaust heat collector 23 and air-conditioning use heater 65 are arranged in the sub cooling water recirculation passage part 90C.

On the other hand, as shown in FIG. 5, the water jacket 14 is connected through an auxiliary cooling water passage 90E to the sub cooling water recirculation passage part 90A, while a multifunctional valve 91 is arranged at this auxiliary cooling water passage 90E. FIG. 7 shows the relationship between the opening degree of this multifunctional valve 91 and the cooling water temperature TW detected by the water temperature sensor 40. As shown in FIG. 7, when the cooling water temperature TW is lower than a set water temperature TW2, the multifunctional valve 91 is fully closed. If the cooling water temperature TW becomes higher than the set water temperature TW2, the multifunctional valve 91 fully opens or fully closes in accordance with the recirculation action of the EGR gas. Note that, in the example shown in FIG. 7, the set water temperature TW2 is made 60° C.

Figure 8:
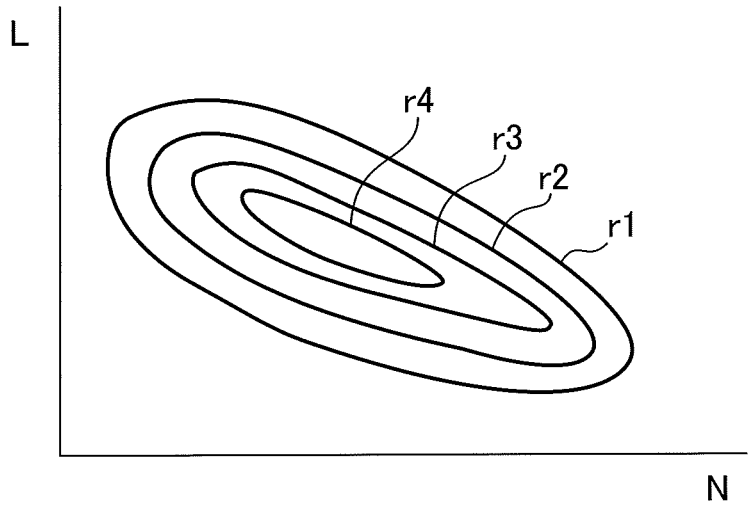
FIG. 8 is a view showing an EGR rate.

FIG. 8 shows the relationship between EGR rates r1, r2, r3, and r4 and an engine load L and engine speed N. In FIG. 8, the solid line of EGR rate=r1 shows when the EGR rate is zero. In the region outside from the solid line of EGR rate=r1, the EGR rate is made zero, that is, the EGR control valve 25 is made to close. On the other hand, at the region inside from the solid line of EGR rate=r1, the EGR control valve 25 is made to open and the EGR rate becomes higher in the order of r2, r3, and r4. In the embodiment according to the present invention, when the cooling water temperature TW is higher than the set water temperature TW2, if the EGR control valve 25 closes, the multifunctional valve 91 is also made to close, while if the EGR control valve 25 opens, the multifunctional valve 91 is also made to open.

As shown in FIG. 7, when the cooling water temperature TW is lower than the set water temperature TW2, the multifunctional valve 91 is closed. At this time, as will be understood from FIG. 5, small amounts of cooling water continue to be supplied to the EGR cooler 26, EGR control valve 25, throttle body 18, air-conditioning use heater 65, and exhaust heat collector 23. On the other hand, when the cooling water temperature TW is higher than the set water temperature TW2, if the EGR control valve 25 is made to close, the multifunctional valve 91 is also made to close, while if the EGR control valve 25 is made to open, the multifunctional valve 91 is also made to open. When the multifunctional valve 91 is made to open, the amounts of cooling water supplied to the EGR cooler 26, EGR control valve 25, throttle body 18, air-conditioning use heater 65, and exhaust heat collector 23 are increased.

Further, in the example shown in FIG. 5, the water temperature sensor 40 is arranged inside the cooling water supply chamber 71. However, this water temperature sensor 40 can also be arranged inside the water jacket 13. That is, the water temperature sensor 40 is arranged at a location enabling detection of the temperature of the cooling water flowing out from the water pump 27. Note that, in the embodiment according to the present invention, the cooling water temperature detected by the water temperature sensor 40 will be referred to as the "engine cooling water temperature".

Figure 9:
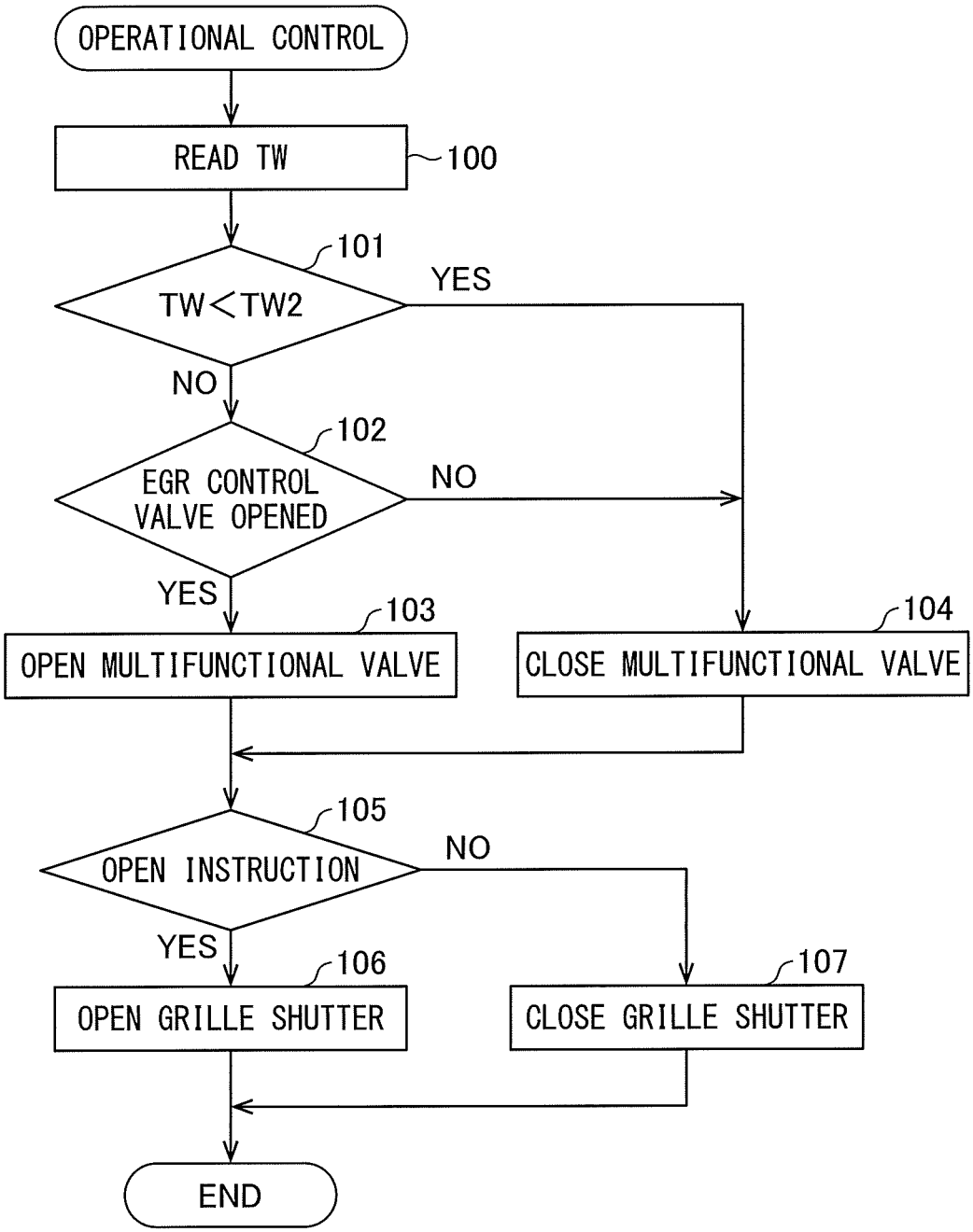
FIG. 9 is a flow chart for performing operational control.

FIG. 9 shows an operational control routine performed in the embodiment according to the present invention. This operational control routine is performed by interruption every fixed time. If referring to FIG. 9, first, at step 100, the engine cooling water temperature TW detected by the water temperature sensor 40 is read in. Next, at step 101, it is judged if the engine cooling water temperature TW is lower than the set water temperature TW2 shown in FIG. 7. When the engine cooling water temperature TW is lower than the set water temperature TW2, the routine proceeds to step 104 where the multifunctional valve 91 is closed. Next, the routine proceeds to step 105.

On the other hand, when at step 101 it is judged that the engine cooling water temperature TW is not lower than the set water temperature TW2, the routine proceeds to step 102 where it is judged if the EGR control valve 25 is made to open. When the EGR control valve 25 is made to open, the routine proceeds to step 103 where the multifunctional valve 91 is opened, then the routine proceeds to step 105. As opposed to this, when the EGR control valve 25 is made to close, the routine proceeds to step 104 where the multifunctional valve 91 is closed. Next, at step 105, it is judged if a grille shutter opening instruction for making the grille shutter 50 open is issued. When the grille shutter opening instruction is issued, the routine proceeds to step 106 where the grille shutter 50 is made to open, while when the grille shutter opening instruction is not issued, the routine proceeds to step 107 where the grille shutter 50 is made to close.

Figure 10:
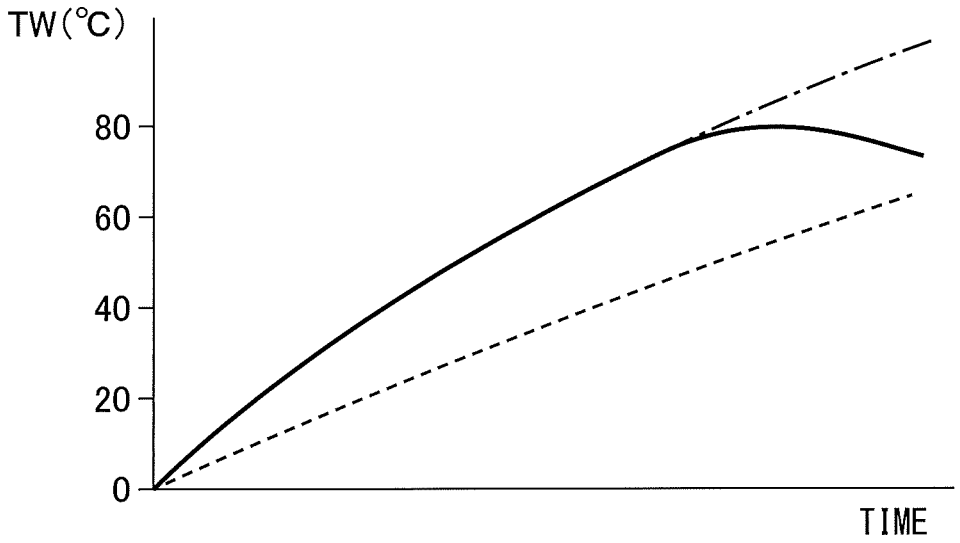
FIG. 10 is a view showing changes in the engine cooling water temperature.

FIG. 10 shows the changes in the engine cooling water temperature TW from the time of engine startup. In FIG. 10, the solid line shows when the thermostat 78 is operating normally in a certain operating state, the broken line shows when the thermostat 78 is suffering from a valve opening abnormality where the opening part 76 of the main cooling water recirculation passage 74 continues open, and the dash dot line shows when the thermostat 78 is suffering from a valve closing abnormality where the opening part 76 of the main cooling water recirculation passage 74 continues closed. That is, when the thermostat 78 is suffering from the valve opening abnormality, cooling water is made to circulate through the inside of the radiator 28 from right after engine startup, so the cooling water does not rise in temperature that easily and, therefore, the engine cooling water temperature TW slowly rises as shown by the broken line. On the other hand, if the thermostat 78 suffers from the valve closing abnormality, even if the cooling water rises in temperature, the cooling water is not supplied to the radiator 28, so the engine cooling water temperature TW continues to rise such as shown by the dash dot line.

If, in this way, the thermostat 78 suffers from the valve opening abnormality or the valve closing abnormality, the way the engine cooling water temperature TW changes after engine startup differs from normal times. Therefore, if comparing the way the measured engine cooling water temperature TW changes with the way the engine cooling water temperature TW changes at normal times, it can be judged if the thermostat 78 is suffering from the valve opening abnormality or the valve closing abnormality. For this, it becomes necessary to estimate the way the engine cooling water temperature TW changes at normal times. Therefore, in the embodiment according to the present invention, a neural network is used to estimate the changes in the engine cooling water temperature TW at normal times.

Figure 11:
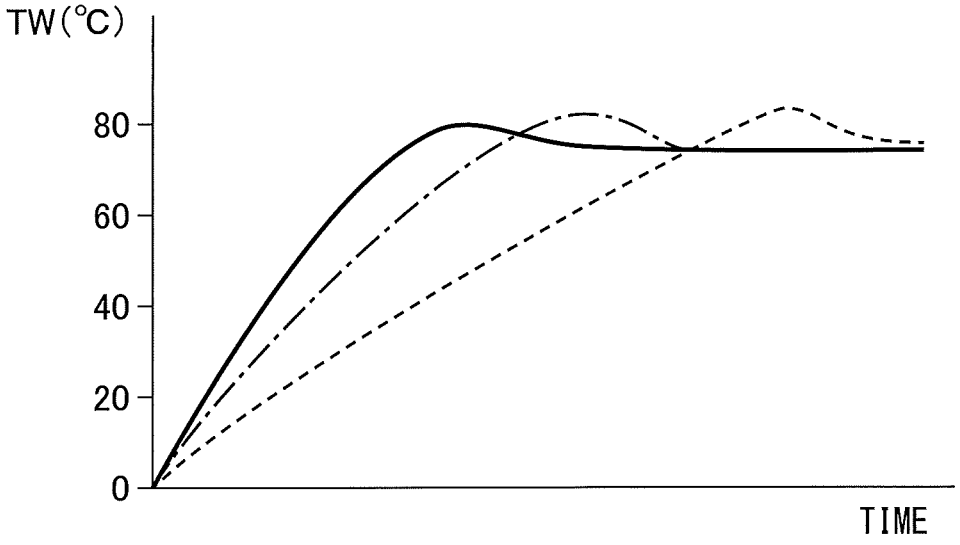
FIG. 11 is a view showing changes in the engine cooling water temperature.

In this regard, if the vehicle is provided with the grille shutter 50 or is provided with the air-conditioning device 61, the pattern of change of the engine cooling water temperature TW at normal times greatly changes depending on the operating state of the grille shutter 50 or on whether the air blown by the blower 63 is circulating through the air-conditioning use heater 65. For example, if, in FIG. 11, the change of the engine cooling water temperature TW at normal times when the grille shutter 50 is closed and the air blown by the blower 63 is not circulating through the air-conditioning use heater 65 is shown by the solid line, the pattern of change of the engine cooling water temperature TW at normal times when the grille shutter 50 is opened and the air blown by the blower 63 is not circulating through the air-conditioning use heater 65, as shown by the broken line in FIG. 11, greatly changes compared with the case shown by the solid line. Further, the pattern of change of the engine cooling water temperature TW at normal times when the grille shutter 50 is closed and the air blown by the blower 63 is circulating through the air-conditioning use heater 65 also, as shown by the dash dot line in FIG. 11, greatly changes compared with the case shown by the solid line.

If in this way the pattern of change of the engine cooling water temperature TW greatly changes, even if the operating state of the grille shutter 50 and state of whether the air blown by the blower 63 is circulating through the air-conditioning use heater 65 are added to the input parameters of the neural network, it becomes difficult to learn the weights of a neural network so as to be able to accurately predict the engine cooling water temperature TW for the operating state of the grille shutter 50 and the state of whether the air blown by the blower 63 is circulating through the air-conditioning use heater 65. Therefore, it becomes difficult to precisely predict the changes in the engine cooling water temperature TW just by adding to the input parameters of the neural network the operating state of the grille shutter 50 and the state of whether the air blown by the blower 63 is circulating through the air-conditioning use heater 65.

Therefore, in the embodiment according to the present invention, a neural network is prepared for each of the four states comprised of the state where the grille shutter 50 is closed and the air blown by the blower 63 is not circulating through the air-conditioning use heater 65, the state where the grille shutter 50 is opened and the air blown by the blower 63 is not circulating through the air-conditioning use heater 65, the state where the grille shutter 50 is closed and the air blown by the blower 63 is circulating through the air-conditioning use heater 65, and the state where the grille shutter 50 is opened and the air blown by the blower 63 is circulating through the air-conditioning use heater 65 and the weights of the neural network are learned for each state. By preparing the neural networks for the states in this way, there is also the advantage that not only does it become possible to precisely predict changes in the engine cooling water temperature TW, but it becomes possible to reduce the calculation load of the weights by learning the weights of the neural network for each state.

Summary of Neural Network

Figure 12:
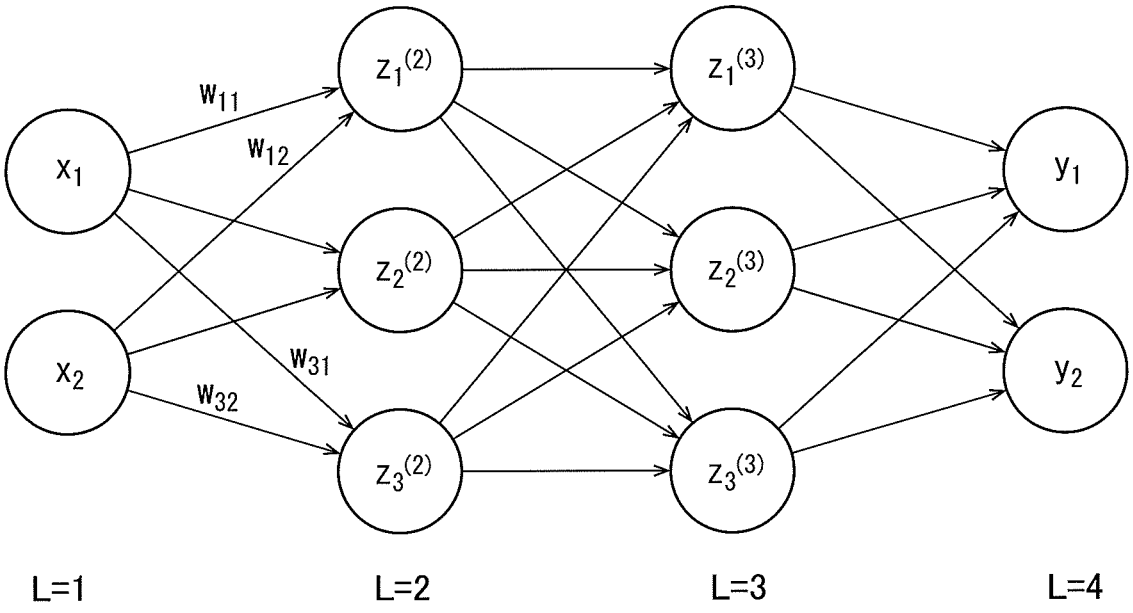
FIG. 12 is a view showing one example of a neural network.

As explained above, in the embodiment according to the present invention, a neural network is used to estimate the engine cooling water temperature TW. Therefore, first, a neural network will be briefly explained. FIG. 12 shows a simple neural network. The circle marks in FIG. 12 show artificial neurons. In the neural network, these artificial neurons are usually called "nodes" or "units" (in the present application, they are called "nodes"). In FIG. 12, L=1 shows an input layer, L=2 and L=3 show hidden layers, and L=4 shows an output layer. Further, in FIG. 12, $x_1$ and $x_2$ show output values from nodes of the input layer (L=1), $y_1$ and $y_2$ show output values from the nodes of the output layer (L=4), $z^{(2)}{}_1$, $z^{(2)}{}_2$, and $z^{(2)}{}_3$ show output values from the nodes of one hidden layer (L=2), and $z^{(3)}{}_1$, $z^{(3)}{}_2$, and $z^{(3)}{}_3$ show output values from the nodes of another hidden layer (L=3). Note that, the numbers of hidden layers may be made one or any other numbers, while the number of nodes of the input layer and the numbers of nodes of the hidden layers may also be made any numbers. Further, the number of nodes of the output layer may be made a single node, but may also be made a plurality of nodes.

At the nodes of the input layer, the inputs are output as they are. On the other hand, the output values $x_1$ and $x_2$ of the nodes of the input layer are input at the nodes of the hidden layer (L=2), while the respectively corresponding weights "w" and biases "b" are used to calculate sum input values "u" at the nodes of the hidden layer (L=2). For example, a sum input value $u_k$ calculated at a node shown by $z^{(2)}{}_k$ (k=1, 2, 3) of the hidden layer (L=2) in FIG. 12 becomes as shown in the following equation:

$$U_k = \sum_{m=1}^{n} (x_m \cdot w_{km}) + b_k$$

Next, this sum input value $u_k$ is converted by an activation function "f" and is output from a node shown by $z^{(2)}{}_k$ of the hidden layer (L=2) as an output value $z^{(2)}{}_k$ (=f($u_k$)). On the other hand, the nodes of the hidden layer (L=3) receive as input the output values $z^{(2)}{}_1$, $z^{(2)}{}_2$, and $z^{(2)}{}_3$ of the nodes of the hidden layer (L=2). At the nodes of the hidden layer (L=3), the respectively corresponding weights "w" and biases "b" are used to calculate the sum input values "u" ($\Sigma z \cdot w + b$). The sum input values "u" are similarly converted by an activation function and output from the nodes of the hidden layer (L=3) as the output values $z^{(3)}{}_1$, $z^{(3)}{}_2$, and $z^{(3)}{}_3$. As this activation function, for example, a Sigmoid function $\sigma$ is used.

On the other hand, at the nodes of the output layer (L=4), the output values $z^{(3)}{}_1$, $z^{(3)}{}_2$, and $z^{(3)}{}_3$ of the nodes of the hidden layer (L=3) are input. At the nodes of the output layer, the respectively corresponding weights "w" and biases "b" are used to calculate the sum input values "u" ($\Sigma z \cdot w + b$) or just the respectively corresponding weights "w" are used to calculate the sum input values "u" ($\Sigma z \cdot w$). In the embodiment according to the present invention, at the nodes of the output layer, an identity function is used, therefore, from the nodes of the output layer, the sum input values "u" calculated at the nodes of the output layer are output as they are as the output values "y".

Learning in Neural Network

Now then, if designating the training data showing the truth values of the output values "y" of the neural network as $y_t$, the weights "w" and biases "b" in the neural network are learned using the error backpropagation algorithm so that the difference between the output values "y" and the training data $y_t$ becomes smaller. This error backpropagation algorithm is known. Therefore, the error backpropagation algorithm will be explained simply below in its outlines. Note that, a bias "b" is one kind of weight "w", so below, a bias "b" will be also be included in what is referred to as a weight "w". Now then, in the neural network such as shown in FIG. 12, if the weights at the input values $u^{(L)}$ to the nodes of the layers of L=2, L=3, or L=4 are expressed by $w^{(L)}$, the differential due to the weights $w^{(L)}$ of the error function E, that is, the slope $\partial E/\partial w^{(L)}$, can be rewritten as shown in the following equation:

$$\partial E/\partial w^{(L)}=(\partial E/\partial u^{(L)})(\partial u^{(L)}/\partial w^{(L)}) \tag{1}$$

where, $z^{(L-1)}\cdot\partial w^{(L)}=\partial u^{(L)}$, so if $(\partial E/\partial u^{(L)})=\delta^{(L)}$, the above equation (1) can be shown by the following equation:

$$\partial E/\partial w^{(L)}=\delta^{(L)}\cdot z^{(L-1)} \tag{2}$$

where, if $u^{(L)}$ fluctuates, fluctuation of the error function E is caused through the change in the sum input value $u^{(L+1)}$ of the following layer, so $\delta^{(L)}$ can be expressed by the following equation:

$$\delta^{(L)} = (\partial E/\partial u^{(L)}) = \sum_{k=1}^{k}(\partial E/\partial u_k^{(L+1)})(\partial u_k^{(L+1)}/\partial u^{(L)})(k = 1, 2 \ldots) \tag{3}$$

where, if expressing $z^{(L)}=f(u^{(L)})$, the input value $u_k^{(L+1)}$ appearing at the right side of the above equation (3) can be expressed by the following formula:

$$\text{input value } u_k^{(L+1)} = \sum_{k=1}^{k} w_k^{(L+1)}\cdot z^{(L)} = \sum_{k=1}^{k} w_k^{(L+1)}\cdot f(u^{(L)}) \tag{4}$$

where, the first term $(\partial E/\partial u^{(L+1)})$ at the right side of the above equation (3) is $\delta^{(L+1)}$, and the second term $(\partial u_k^{(L+1)}/\partial u^{(L)})$ at the right side of the above equation (3) can be expressed by the following equation:

$$\partial(w_k^{(L+1)}\cdot z^{(L)})/\partial u^{(L)}=w_k^{(L+1)}\cdot\partial f(u^{(L)})/\partial u^{(L)}=w_k^{(L+1)}\cdot f'(u^{(L)}) \tag{5}$$

Therefore, $\delta^{(L)}$ is shown by the following formula.

$$\partial^{(L)} = \sum_{k=1}^{k} w_k^{(L+1)}\cdot\delta^{(L+1)}\cdot f'(u^{(L)})$$

That is, $$\partial^{(L-1)} = \sum_{k=1}^{k} w_k^{(L)}\cdot\delta^{(L)}\cdot f'(u^{(L-1)}) \tag{6}$$

That is, if $\delta^{(L+1)}$ is found, it is possible to find $\delta^{(L)}$.

Now then, when there is a single node of the output layer (L=4), training data $y_t$ is found for a certain input value, and the output values from the output layer corresponding to this input value are "y", if the square error is used as the error function, the square error E is found by $E=\frac{1}{2}(y-y_t)^2$. In this case, at the node of the output layer (L=4), the output values "y" become $f(u^{(L)})$, therefore, in this case, the value of $\delta^{(L)}$ at the node of the output layer (L=4) becomes like in the following equation:

$$\delta^{(L)}=\partial E/\partial u^{(L)}=(\partial E/\partial y)(\partial y/\partial u^{(L)})=(y-y_t)\cdot f'(u^{(L)}) \tag{7}$$

In this case, in the embodiments of the present invention, as explained above, $f(u^{(L)})$ is an identity function and $f'(u^{(L1)})=1$. Therefore, this leads to $\delta^{(L)}=y-y_t$ and $\delta^{(L)}$ is found.

If $\delta^{(L)}$ is found, the above equation (6) is used to find the $\delta^{(L-1)}$ of the previous layer. The δ's of the previous layer are successively found in this way. Using these values of δ's, from the above equation (2), the differential of the error function E, that is, the slope $\partial E/\partial w^{(L)}$, is found for the weights "w". If the slope $\partial E/\partial w^{(L)}$ is found, this slope $\partial E/\partial w^{(L)}$ is used to update the weights "w" so that the value of the error function E decreases. That is, the values of the weights "w" are learned. Note that, as shown in FIG. 12, when the output layer (L=4) has a plurality of nodes, if making the output values from the nodes $y_1$, $y_2$ . . . and making the corresponding training data $y_{t1}$, $y_{t2}$ . . . , as the error function E, the following square sum error E is used:

$$\text{Square sum error } E = \frac{1}{2}\sum_{k=1}^{n}(y_k - y_{tk})^2 \tag{8}$$

("n" is number of nodes of output layer)

In this case as well, the values of $\delta^{(L)}$ at the nodes of the output layer (L=4) become $\delta^{(L)}=y-y_{tk}$ (k=1, 2 . . . n). From the values of these $\delta^{(L)}$, the above formula (6) is used to find the $\delta^{(L-1)}$ of the previous layers.

Embodiments According to Present Invention

Figure 13:
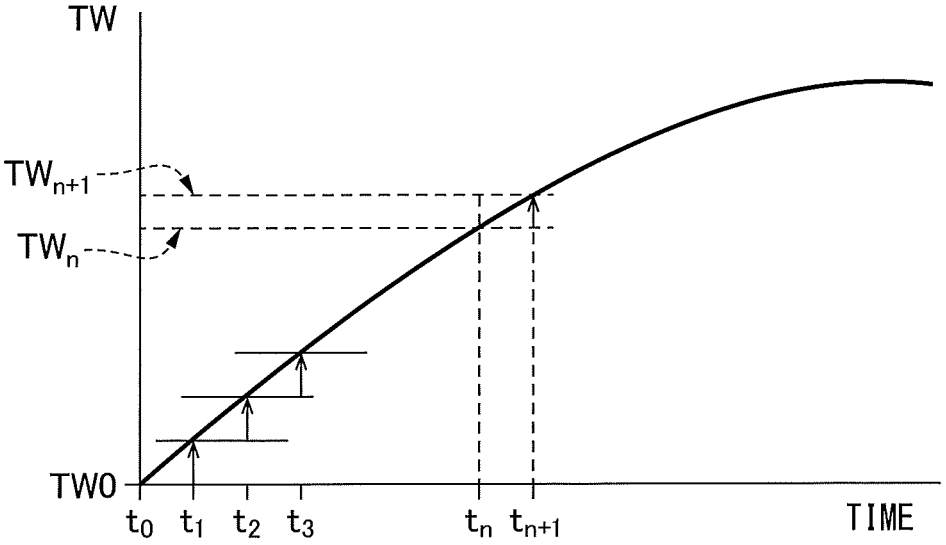
FIG. 13 is a view showing changes in the engine cooling water temperature.

First, referring to FIG. 13, the method of estimating the engine cooling water temperature TW when the thermostat 78 is not suffering from the valve opening abnormality or the valve closing abnormality, that is, when the thermostat 78 is normal, will be explained. Note that, FIG. 13 shows the relationship between the time elapsed after engine startup and the engine cooling water temperature TW. In FIG. 13, if focusing on the time $t_n$ and the time $t_{n+1}$, it is possible to estimate the amount of temperature rise $(TW_{n+1}-TW_n)$ of the engine cooling water temperature TW within a constant time $(t_{n+1}-t_n)$ from the state of the engine at the time $t_n$. That is, if the state of the engine is determined, the amount of heat generation in the heat generating factors making the engine cooling water temperature TW rise and the amount of heat radiation in the heat radiating factors making the engine cooling water temperature TW fall are determined, so the amount of temperature rise $(TW_{n+1}-TW_n)$ of the engine cooling water temperature TW can be estimated from the state of the engine at the time $t_n$. Explained another way, it becomes possible to estimate the engine cooling water temperature $TW_{n+1}$ after a constant time $(t_{n+1}-t_n)$ from the state of the engine at the time $t_n$ $(TW=TW_n)$.

Figure 14:
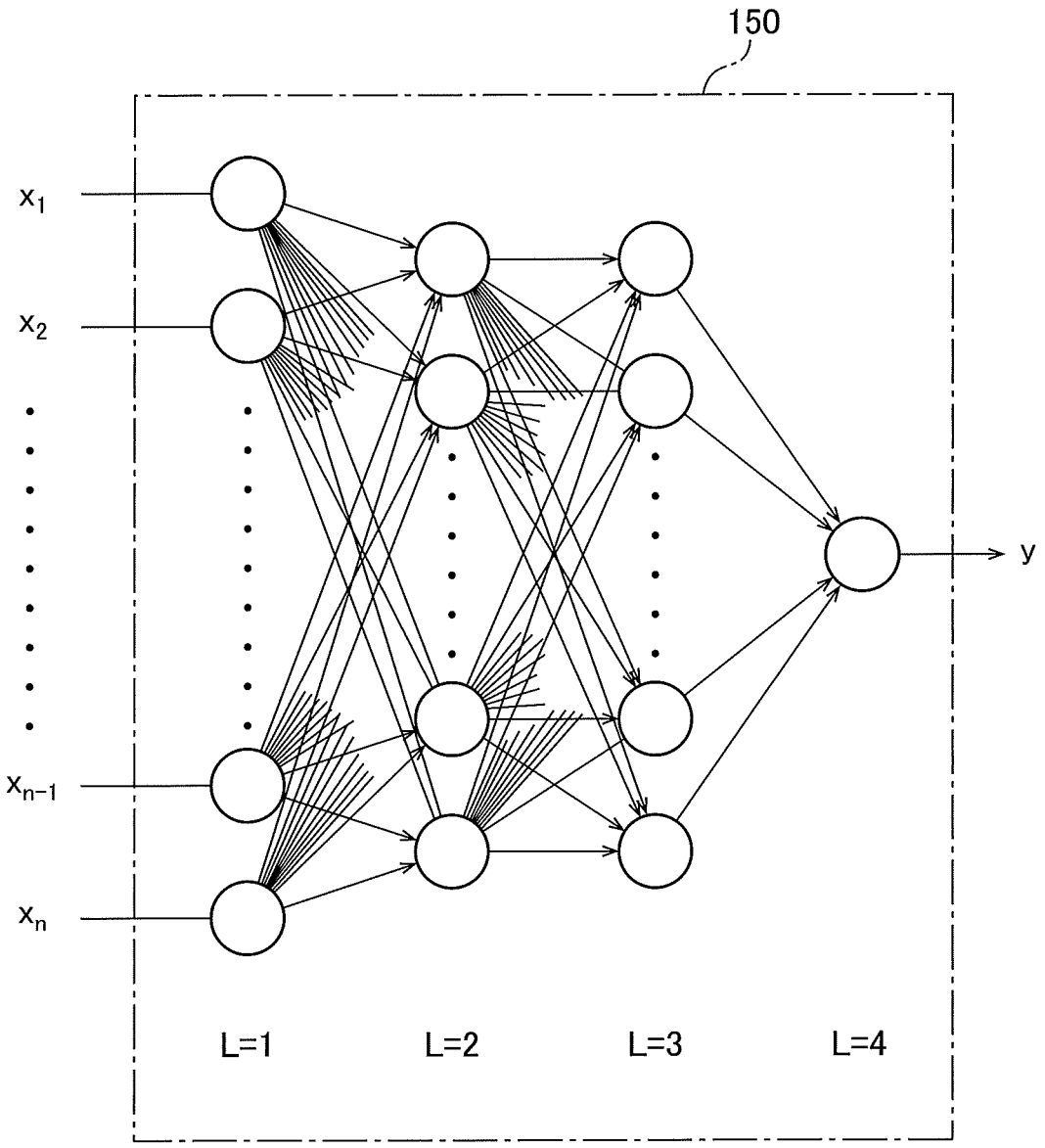
FIG. 14 is a view showing a neural network used in an embodiment according to the present invention.

In this case, in the embodiment according to the present invention, the neural network is used to estimate the engine cooling water temperature $TW_{n+1}$ after a constant time $(t_{n+1}-t_n)$ from the state of the engine at the time $t_n$ $(TW=TW_n)$. To estimate the engine cooling water temperature $TW_{n+1}$ after the constant time $(t_{n+1}-t_n)$ from the state of the engine at the time $t_n$ $(TW=TW_n)$, a model for estimation of the engine cooling water temperature TW is prepared. Therefore, first, a neural network used for preparation of this engine cooling water temperature estimation model will be explained while referring to FIG. 14. If referring to FIG. 14, in this neural network 150 as well, in the same way as the neural network shown in FIG. 12, L=1 shows an input layer, L=2 and L=3 show hidden layers, and L=4 shows an output layer. As shown in FIG. 14, the input layer (L=1) is comprised of "n" number of nodes, and "n" number of input values $x_1$, $x_2$ . . . $x_{n-1}$, and $x_n$ are input to the nodes of the input layer (L=1). On the other hand, FIG. 14 describes the hidden layer (L=2) and hidden layer (L=3), but the number of these hidden layers can also be made one or any other number of layers. Further, the numbers of nodes of these hidden layers can also be made any numbers of nodes. Note that, the number of nodes of the output layer (L=4) is made one node and the output value from the node of the output layer is shown by "y". In this case, the output value "y" becomes the estimated value of the engine cooling water temperature TW.

Next, the input values $x_1$, $x_2$ . . . $x_{n-1}$, and $x_n$ in FIG. 14 will be explained while referring to the list shown in FIG. 15. Now then, as explained above, if the state of the engine is determined, the amount of heat generation in the heat generating factors causing the engine cooling water temperature TW to rise and the amount of heat radiation in the heat radiating factors causing the engine cooling water temperature TW to fall are determined. Therefore, it is possible to estimate the amount of temperature rise ($TW_{n+1}-TW_n$) of the engine cooling water temperature TW, that is, the engine cooling water temperature $TW_{n+1}$ after the constant time ($t_{n+1}-t_n$), from the state of the engine at the time $t_n$. In FIG. 15, the input parameters to the neural network which become these heat generating factors and heat radiating factors are listed. Note that, in FIG. 15, the input parameters having strong effects on the changes in the engine cooling water temperature TW are listed as essential input parameters, and the input parameters having a smaller effect on the changes in the engine cooling water temperature TW as compared with the essential input parameters are listed as auxiliary input parameters.

As shown in FIG. 15, the engine cooling water temperature TW, the amount of air taken into the engine, the amount of fuel injected into the engine, the outside air temperature, and the vehicle speed are made the essential input parameters. Among these essential input parameters, the amount of air taken into the engine and the amount of fuel injected into the engine are heat generating factors, while the outside air temperature and the vehicle speed are heat radiating factors. The fact that these amount of air taken into the engine, amount of fuel injected into the engine, outside air temperature, and vehicle speed are essential input parameters would seem to not require particular explanation. In one embodiment according to the present invention, the values of only these essential input parameters are used as the input values $x_1$, $x_2$ . . . $x_{n-1}$, and $x_n$ at FIG. 14. Note that, in this case, instead of the vehicle speed, the amount of air of the cooling-use electric fan 29 of the radiator 28, that is, the speed of the electric fan 29, can also be used.

On the other hand, as shown in FIG. 15, the ignition timing, EGR rate, opening timing of the exhaust valve 8, and engine speed are considered auxiliary input parameters. These ignition timing, EGR rate, and opening timing of the exhaust valve 8 are heat generating factors, while the engine speed is a heat radiating factor. That is, if the ignition timing is advanced, the combustion temperature rises, while if the EGR rate becomes higher, the combustion temperature falls. Further, if the opening timing of the exhaust valve 8 is retarded and the valve overlap period where the intake valve 6 and the exhaust valve 8 both open becomes longer, the amount of exhaust gas blown back from the exhaust port 9 to the combustion chamber 5 increases and, as a result, the combustion temperature falls. In this way, the ignition timing, EGR rate, and opening timing of the exhaust valve 8 have an effect on the combustion temperature, so these ignition timing, EGR rate, and opening timing of the exhaust valve 8 become heat generating factors.

As opposed to this, if the engine speed becomes higher, the speed of the water pump 27 becomes higher, so the amount of recirculation of the engine cooling water changes and the amount of heat escaping from the engine cooling water to the outside air changes. Therefore, the engine speed is a heat radiating factor. Note that, instead of the engine speed, the flow rate of the electric water pump, that is, the speed of the electric water pump, can also be used. In this regard, as explained above, the values of only the essential input parameters can also be made the input values $x_1$, $x_2$ . . . $x_{n-1}$, and $x_n$ in FIG. 14. Of course, in addition to the values of the essential input parameters, the values of the auxiliary input parameters can also be made the input values $x_1$, $x_2$ . . . $x_{n-1}$, and $x_n$ in FIG. 14. Note that, below, an example according to the present invention will be explained with reference to an example of the case of making the values of the auxiliary input parameters the input values $x_1$, $x_2$ . . . $x_{n-1}$, and $x_n$ in FIG. 14 in addition to the values of the essential input parameters.

FIG. 16 shows a training data set prepared using the input values $x_1$, $x_2$ . . . $x_{n-1}$, and $x_n$ and the training data yt. In this FIG. 16, the input values $x_1$, $x_2$ . . . $x_{n-1}$, and $x_n$ respectively show the engine cooling water temperature TW, the amount of air taken into the engine, the amount of fuel injected into the engine, the outside air temperature, the vehicle speed, the ignition timing, the EGR rate, the opening timing of the exhaust valve 8, and the engine speed. In this case, the engine cooling water temperature TW is detected by the water temperature sensor 40, the amount of air taken into the engine is detected by the intake air amount detector 19, the outside air temperature is detected by the outside air temperature sensor 41, the vehicle speed is detected by the vehicle speed sensor 45, while the amount of fuel injected into the engine, the ignition timing, the EGR rate, the opening timing of the exhaust valve 8, and the engine speed are calculated inside the electronic control unit 30.

On the other hand, if explained using the times $t_n$ and $t_{n+1}$ in FIG. 13, the input values $x_1$, $x_2$ . . . $x_{n-1}$, and $x_n$ in FIG. 16 show the input values at the time $t_n$, while the training data yt in FIG. 16 shows the measured value of the engine cooling water temperature TW after the constant time ($t_{n+1}-t_n$). As shown in FIG. 16, in this training data set, "m" number of data showing the relationship between the input values $x_1$, $x_2$ . . . $x_{n-1}$, and $x_n$ and the training data yt are acquired. For example, in the No. 2 data, the acquired input values $x_{12}$, $x_{22}$ . . . $x_{m-12}$, and $x_{m2}$ and training data $yt_2$ are listed, while in the No. m−1 data, the input values $x_{1m-1}$, $x_{2m-1}$ . . . $x_{n-1m-1}$, and $x_{nm-1}$ of the acquired input parameters and training data $yt_{m-1}$ are listed.

Now, in the embodiment according to the present invention, as explained above, a neural network is prepared for each of the four states of the state where the grille shutter 50 is closed and the air blown by the blower 63 is not circulating through the air-conditioning use heater 65, the state where the grille shutter 50 is opened and the air blown by the blower 63 is not circulating through the air-conditioning use heater 65, the state where the grille shutter 50 is closed and the air blown by the blower 63 is circulating through the air-conditioning use heater 65, and the state where the grille shutter 50 is opened and the air blown by the blower 63 is circulating through the air-conditioning use heater 65. These neural networks are shown by the reference notations 150A, 150B, 150C, and 150D in FIG. 17A to FIG. 17D.

In this case, the training data set shown in FIG. 16 is prepared for each of the four neural networks 150A, 150B, 150C, and 150D shown from FIG. 17A to FIG. 17D. The respectively corresponding training data sets are used for learning the weights of the neural networks 150A, 150B, 150C, and 150D shown from FIG. 17A to FIG. 17D. Therefore, next, the method of preparation of the training data set shown in FIG. 16 will be explained.

Figure 18:
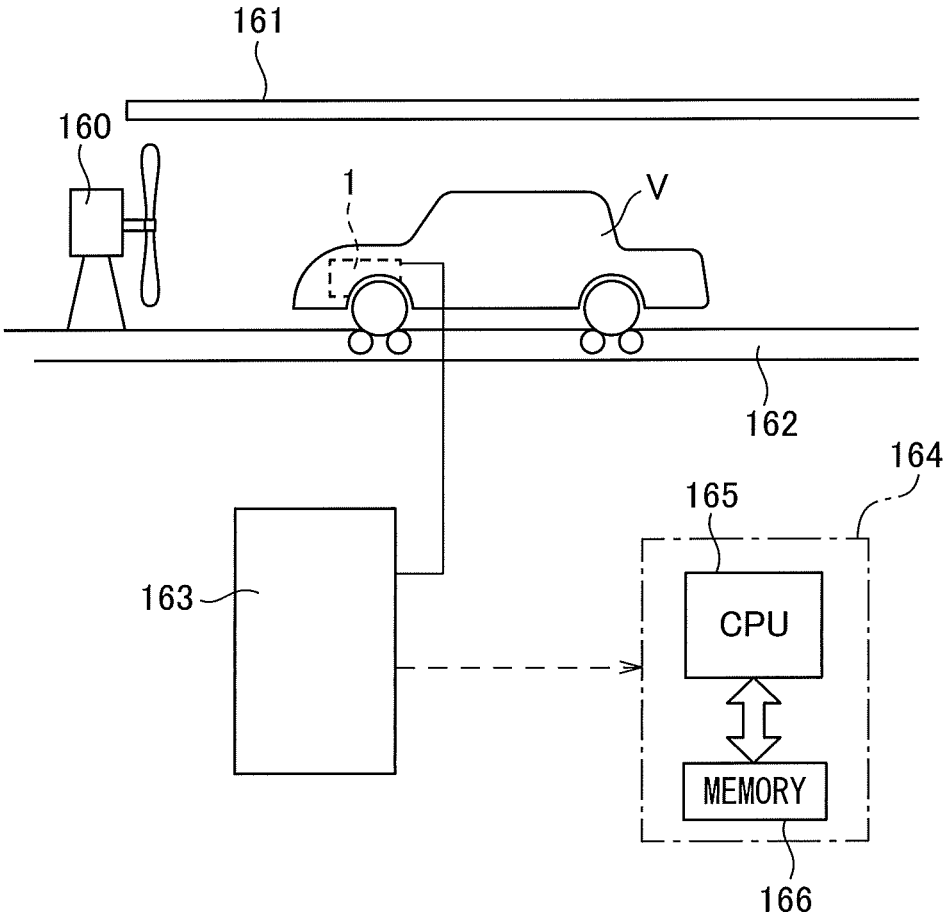
FIG. 18 is a view for explaining a learning method.

FIG. 18 shows one example of a method for preparing a training data set. If referring to FIG. 18, a vehicle V provided with the engine body 1, grille shutter 50, and air-conditioning device 61 which are shown in FIG. 1 is placed on a chassis bed 162 of a wind tunnel 161 having a blower 160 and a simulation apparatus 163 is used to pseudo run the vehicle V on the chassis bed 162. In this pseudo running, for example, the state of the grille shutter 50 and the state of circulation of the delivered air in the air-conditioning use heater 65 are successively changed to the above-mentioned four states and, in the changed states, the combinations of the values of the engine cooling water temperature TW, the amount of air taken into the engine, the amount of fuel injected into the engine, the outside air temperature, the vehicle speed, the ignition timing, the EGR rate, the opening timing of the exhaust valve 8, and the engine speed are successively changed while repeatedly the engine is started up and operated to warm up.

While this pseudo running is performed, the data required for preparing the training data sets is acquired. If explaining this using the times $t_n$ and $t_{n+1}$ at FIG. 13, while pseudo running is being performed, the state of the grille shutter 50, the state of circulation of blown air at the air-conditioning use heater 65, and the combinations of the measured values of the engine cooling water temperature TW, amount of air taken into the engine, amount of fuel injected into the engine, outside air temperature, vehicle speed, ignition timing, EGR rate, opening timing of the exhaust valve 8, and engine speed at the different times $t_n$ (n=0, 1, 2 . . . ) in FIG. 13 and the measured values of the engine cooling water temperature TW at the time $t_{n+1}$ at FIG. 13 are, for example, stored inside the simulation device 163. That is, the No. 1 to No. "m" input values $x_{1m}$, $x_{2m}$ . . . $x_{nm-1}$, and $x_{nm}$ and the training data $yt_m$ (m=1, 2, 3 . . . "m") of the training data sets shown in FIG. 16 are, for example, stored inside the simulation device 163.

In this way, training data sets such as shown in FIG. 16 are respectively prepared for the four states comprised of the state where the grille shutter 50 is closed and the air blown by the blower 63 does not circulate through the air-conditioning use heater 65, the state where the grille shutter 50 is opened and the air blown by the blower 63 does not circulate through the air-conditioning use heater 65, the state where the grille shutter 50 is closed and the air blown by the blower 63 circulates through the air-conditioning use heater 65, and the state where the grille shutter 50 is opened and the air blown by the blower 63 circulates through the air-conditioning use heater 65. The electronic data of the training data sets prepared in this way is used for learning the weights of the neural networks 150A, 150B, 150C, and 150D shown from FIG. 17A to FIG. 17D.

In the example shown in FIG. 18, a learning device 164 for learning the weights of the neural network is provided. As this learning device 164, a PC can also be used. As shown in FIG. 18, this learning device 164 is provided with a storage device 166, that is, a memory 166 and a CPU (microprocessor) 165. In the example shown in FIG. 18, the numbers of nodes of the neural networks shown in FIG. 17A to FIG. 17D and the electronic data of the prepared training data sets are stored in the memory 166 of the learning device 164, and the weights of the neural networks are learned in the CPU 165.

Figure 19:
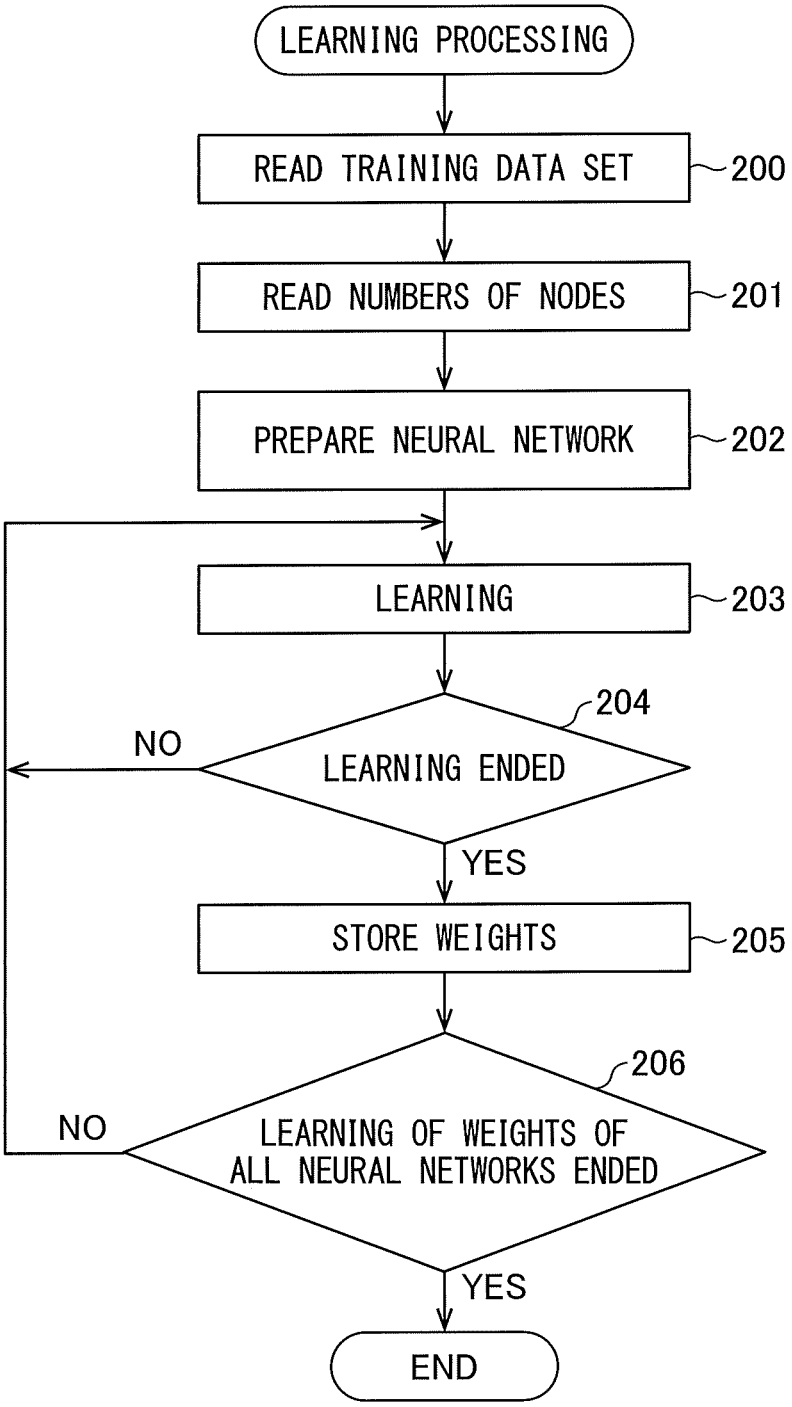
FIG. 19 is a flow chart for performing learning processing.

FIG. 19 shows a processing routine for learning weights of the neural networks performed at the learning device 164. Referring to FIG. 19, first, at step 200, the data of the training data sets for the neural networks 150A, 150B, 150C, and 150D stored in the memory 166 of the learning device 164 are read in. Next, at step 201, the numbers of nodes of the input layers (L=1), the numbers of nodes of the hidden layers (L=2) and hidden layers (L=3), and the numbers of nodes of the output layers (L=4) of the neural networks 150A, 150B, 150C, and 150D are read in. Next, at step 202, the four neural networks 150A, 150B, 150C, and 150D such as shown in FIG. 17A to FIG. 17D are prepared based on these numbers of nodes.

Next, at step 203, the weights of the neural network 150A are learned. At this step 203, first, the No. 1 input values $x_1$, $x_2$ . . . $x_{n-1}$, and $x_n$ of FIG. 16 are input to the nodes of the input layer (L=1) of the neural network 150A. At this time, from the output layer of the neural network 150A, an output value "y" showing the estimated value of the engine cooling water temperature TW after a constant time ($t_{n+1}-t_n$ in FIG. 13) is output. If the output value "y" is output from the output layer of the neural network 150A, the squared error $E=\frac{1}{2}(y-y_{t1})^2$ between this output value "y" and the No. 1 training data $yt_1$ is calculated, and the weights of the neural network 150A are learned using the above-mentioned error backpropagation algorithm so that this squared error E becomes smaller.

If the weights of the neural network 150A finish being learned based on the No. 1 data of FIG. 16, next, the weights of the neural network 20 are learned based on the No. 2 data of FIG. 16 using the error backpropagation algorithm. Similarly, the weights of the neural network 150A are successively learned until the No. "m" data of FIG. 16. If the weights of the neural network 150A finish being learned for all of the No. 1 to No. "m" data of FIG. 16, the routine proceeds to step 204.

At step 204, for example, the square sum error E between all of the output values "y" of the neural network and training data yt of the No. 1 to No. "m" data of FIG. 16 is calculated. It is judged if the square sum error E becomes a predetermined set error or less. When it is judged that the square sum error E does not become the predetermined set error or less, the routine returns to step 203 where again the weights of the neural network 150A are learned based on the training data set shown in FIG. 16. Next, the weights of the neural network 150A continue being learned until the square sum error E becomes the predetermined set error or less. When at step 204 it is judged that the square sum error E becomes the predetermined set error or less, the routine proceeds to step 205 where the learned weights of the neural network 150A are stored in the memory 166 of the learning device 164. Next, the routine proceeds to step 206.

Figure 17A:
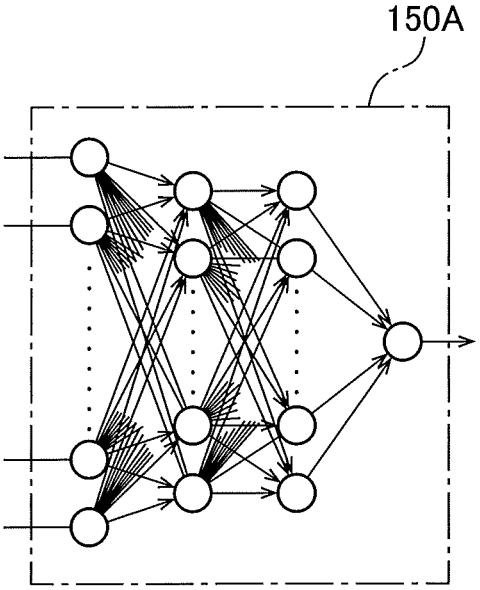
FIGS. 17A, 17B, 17C, and 17D are views showing neural networks.
Figure 17B:
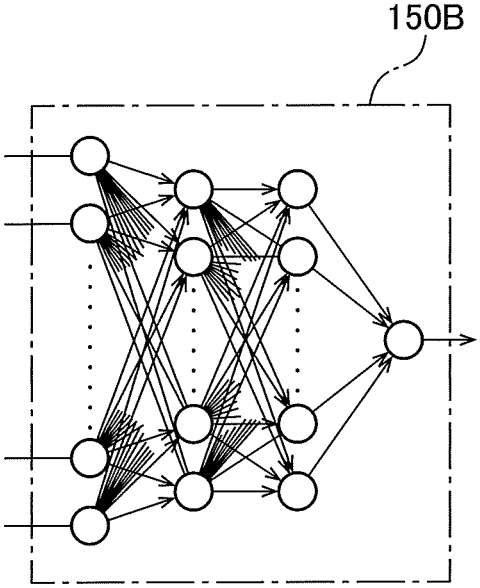
Figure 17C:
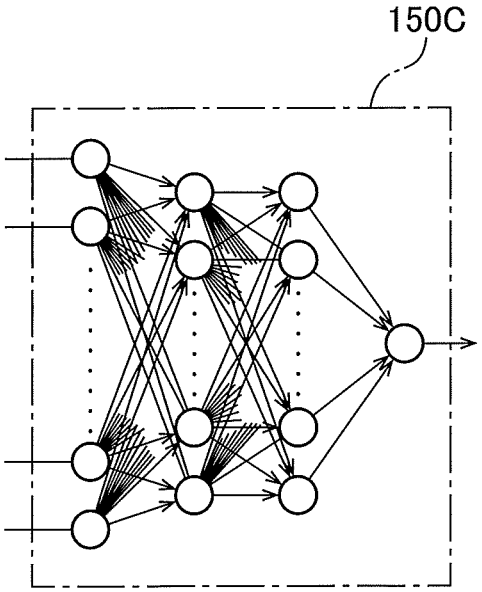
Figure 17D:
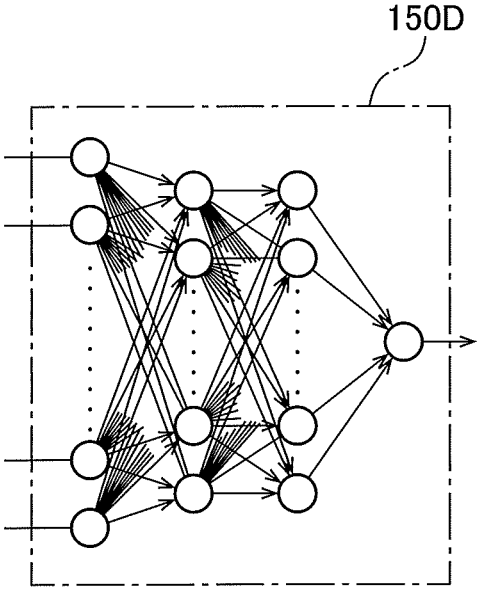

At step 206, it is judged if the weights of all of the neural networks 150A, 150B, 150C, and 150D shown from FIG. 17A to FIG. 17D have finished being learned. When the weights of all of the neural networks 150A, 150B, 150C, and 150D have not finished being learned, the routine returns to step 203 where the weights of the neural networks for which the weights have still not yet finished being learned, for example, the neural network 150B shown in FIG. 17B, are learned. If the weights of the neural network 150B finish being learned, at step 205, the learned weights of the neural network 150B are stored in the memory 166 of the learning device 164.

In this way, the weights of all of the neural networks 150A, 150B, 150C, and 150D shown from FIG. 17A to FIG. 17D are learned and the learned weights of the neural networks 150A, 150B, 150C, and 150D are stored in the memory 166 of the learning device 164. That is, a model for estimation of the engine cooling water temperature is prepared for each of the four states of a state where the grille shutter 50 is closed and the air blown by the blower 63 is not circulating through the air-conditioning use heater 65, a state where the grille shutter 50 is opened and the air blown by the blower 63 is not circulating through the air-conditioning use heater 65, a state where the grille shutter 50 is closed and the air blown by the blower 63 is circulating through the air-conditioning use heater 65, and a state where the grille shutter 50 is opened and the air blown by the blower 63 is circulating through the air-conditioning use heater 65.

Figure 20:
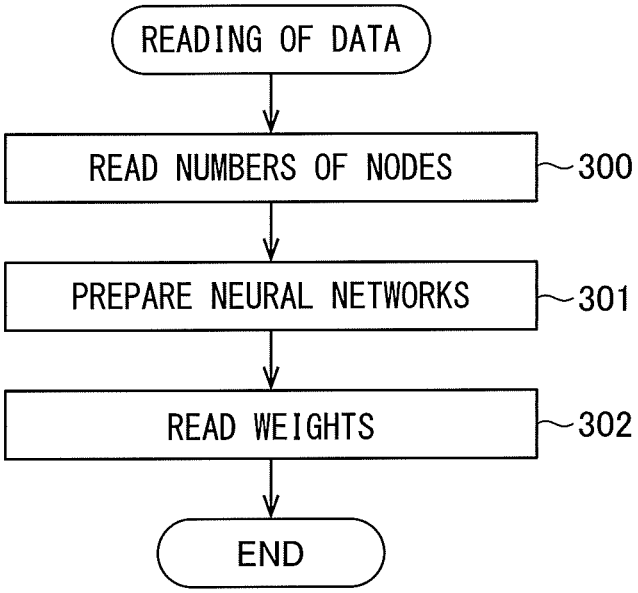
FIG. 20 is a flow chart for reading data in the electronic control unit.

In the embodiment according to the present invention, the model of estimation of the engine cooling water temperature prepared in this way is used to diagnose faults of the thermostat 78 etc. at a commercially available vehicle. For this reason, the model of estimation of the engine cooling water temperatures is stored in the electronic control unit 30 of the commercially available vehicle. FIG. 20 shows a data read routine to the electronic control unit performed at the electronic control unit 30 for storing the model of estimation of the engine cooling water temperature in the electronic control unit 30 of a commercially available vehicle.

Referring to FIG. 20, first, at step 300, the number of nodes of the input layer (L=1), the numbers of nodes of the hidden layer (L=2) and hidden layer (L=3), and number of nodes of the output layer (L=4) of the four neural networks 150A, 150B, 150C, and 150D shown in FIG. 17A to FIG. 17D are read into the memory 32 of the electronic control unit 30. Next, at step 301, based on these numbers of nodes, the four neural networks 150A, 150B, 150C, and 150D shown in FIG. 17A to FIG. 17D are prepared. Next, at step 302, the learned weights of these neural networks 150A, 150B, 150C, and 150D are read into the memory 32 of the electronic control unit 30. Due to this, the model of estimation of the engine cooling water temperature is stored in the electronic control unit 30 of a commercial vehicle.

Figure 21:
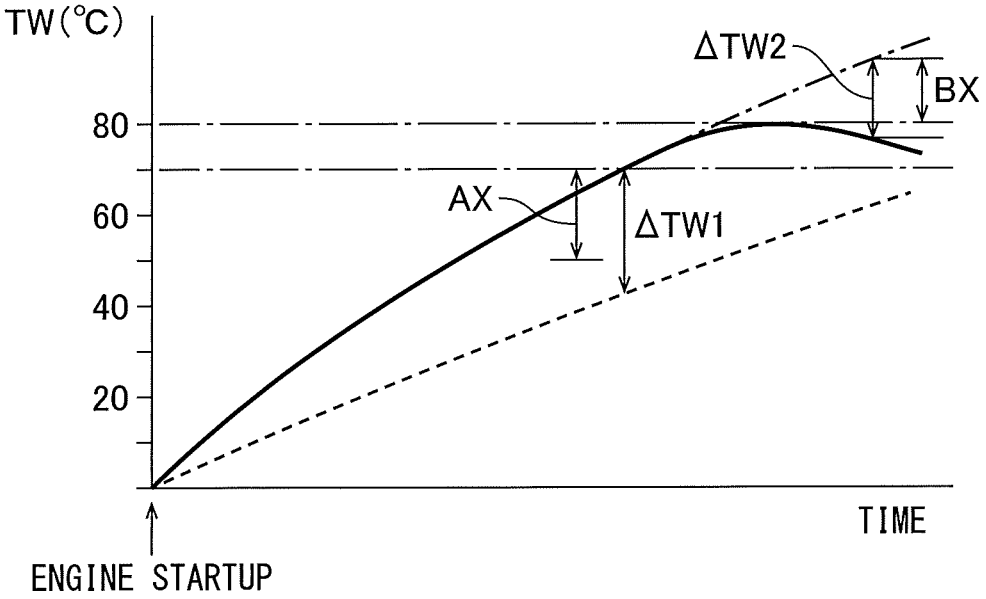
FIG. 21 is a view showing changes in an engine cooling water temperature.

Next, referring to FIG. 21, the method of fault diagnosis of the thermostat 78 performed at a commercially available vehicle will be explained. FIG. 21 shows the changes in the engine cooling water temperature TW from the time of engine startup. In FIG. 21, the solid line, in the same way as FIG. 10, shows the time when the thermostat 78 is operating normally in a certain operating state, the broken line shows when the thermostat 78 suffers from the valve opening abnormality continuing to open the opening part 76 of the main cooling water recirculation passage 74, and the dash dot line shows when the thermostat 78 suffers from the valve closing abnormality continuing to close the opening part 76 of the main cooling water recirculation passage 74. That is, as explained above, when the thermostat 78 suffers from the valve opening abnormality, the cooling water is made to circulate through the inside of the radiator 28 from right after engine startup, so the cooling water does not easily rise in temperature. Therefore, the engine cooling water temperature TW slowly rises as shown by the broken line. On the other hand, if the thermostat 78 suffers from the valve closing abnormality, even if the cooling water rises in temperature, the cooling water is not supplied to the radiator 28, so the engine cooling water temperature TW continues to rise such as shown by the dash dot line.

In this way, if the thermostat 78 suffers from the valve opening abnormality or the valve closing abnormality, the way the engine cooling water temperature TW changes after engine startup differs from normal times. Therefore, if comparing the way the measured engine cooling water temperature TW changes with the way the engine cooling water temperature TW at normal times changes, it becomes possible to judge if the thermostat 78 is suffering from the valve opening abnormality or the valve closing abnormality. In this case, in the embodiment according to the present invention, the engine cooling water temperature TW at normal times is estimated using the model of estimation of the engine cooling water temperature stored in the electronic control unit 30. From the estimated value of the engine cooling water temperature TW estimated by this model of estimation and the measured value of the engine cooling water temperature TW detected by the water temperature sensor 40, it is judged if the thermostat 78 is suffering from the valve opening abnormality or the valve closing abnormality.

Explaining a specific example performed in the embodiment according to the present invention, as shown in FIG. 21, when the estimated value of the engine cooling water temperature TW shown by the solid line reaches the valve opening temperature of the thermostat 78, for example, 70° C., if the difference ΔTW1 of the estimated value of the engine cooling water temperature TW minus the measured value of the engine cooling water temperature TW is larger than the predetermined difference AX, it is judged that the thermostat 78 is suffering from the valve opening abnormality. In other words, in this embodiment according to the present invention, if the amount of rise of the measured value of the engine cooling water temperature TW is lower compared with the amount of rise of the estimated value of the engine cooling water temperature TW after engine startup, it is judged that an abnormality in operation of the thermostat 78 which causes cooling water to continue to circulate from the main cooling water recirculation passage 74 toward the water pump 27 occurs.

Further, when the thermostat 78 is normal, if the thermostat 78 fully opens, the engine cooling water running through the radiator 28 increases, so the engine cooling water temperature TW, as shown by the solid line, falls a little at a time after the thermostat 78 has fully opened. Therefore, in this embodiment according to the present invention, when after the estimated value of the engine cooling water temperature TW has reached its peak, the difference ΔTW2 of the measured value of the engine cooling water temperature TW minus the estimated value of the engine cooling water temperature TW becomes larger than the predetermined difference BX, it is judged that the thermostat 78 is suffering from the valve closing abnormality. In other words, in this embodiment according to the present invention, if the amount of rise of the measured value of the engine cooling water temperature TW is higher compared with the amount of rise of the estimated value of the engine cooling water temperature TW after engine startup, it is judged that an abnormality in operation of thermostat 78 which continues to stop the circulation of cooling water from the main cooling water recirculation passage 74 toward the water pump 27 occurs.

Figure 22:
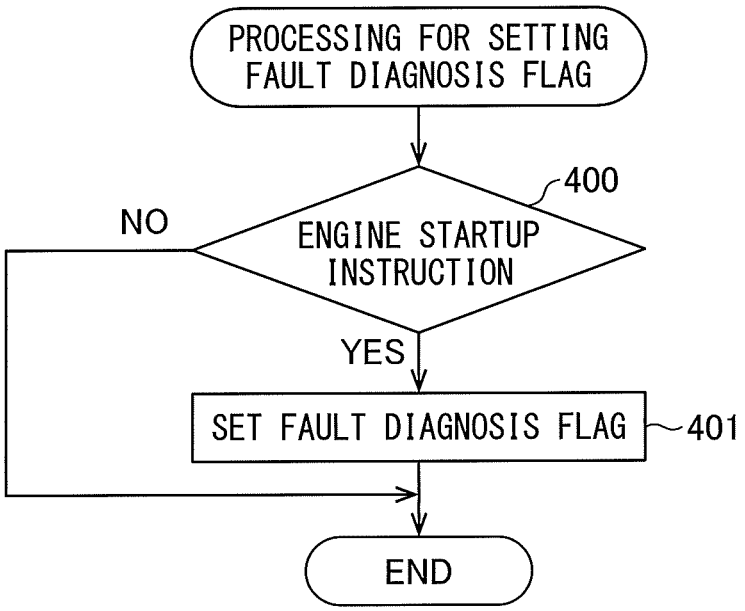
FIG. 22 is a flow chart for performing processing for setting a fault diagnosis flag.

FIG. 22 shows a routine for setting a fault diagnosis flag performed at the electronic control unit 30. In the embodiment according to the present invention, if this fault diagnosis flag is set, fault diagnosis of the thermostat 78 is started. Referring to FIG. 22, first, at step 400, it is judged if an instruction for startup of the engine is issued at the electronic control unit 30. If the instruction for startup of the engine is issued at the electronic control unit 30, the engine is started up by the drive motor in the drive control mechanism 46. When at step 400 it is judged that the instruction for startup of the engine is not issued, the processing cycle is ended. As opposed to this, when it is judged that the instruction for startup of the engine is issued, the routine proceeds to step 401 where a fault diagnosis flag is set.

Figure 23:
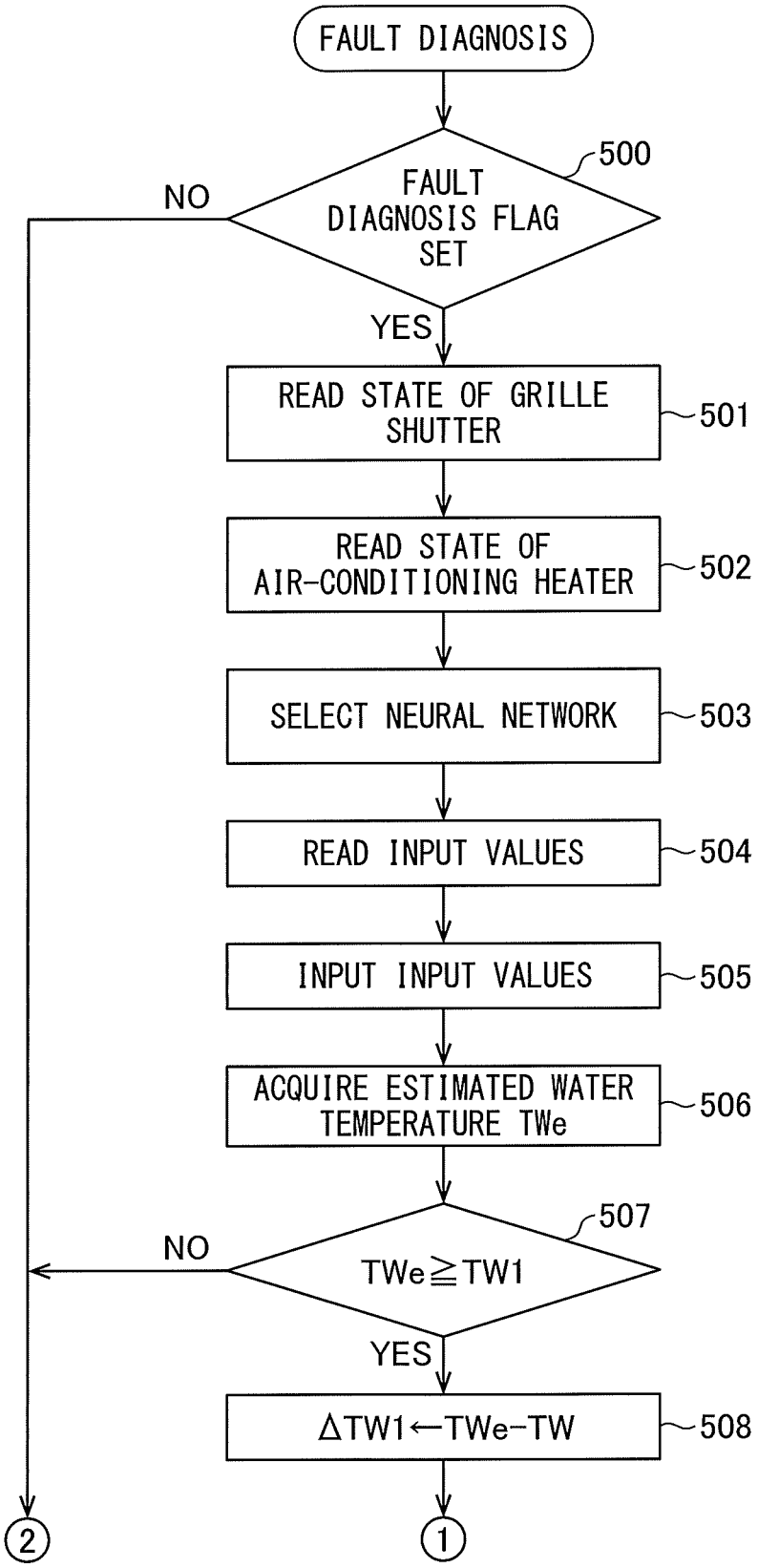
FIG. 23 is a flow chart for fault diagnosis.
Figure 24:
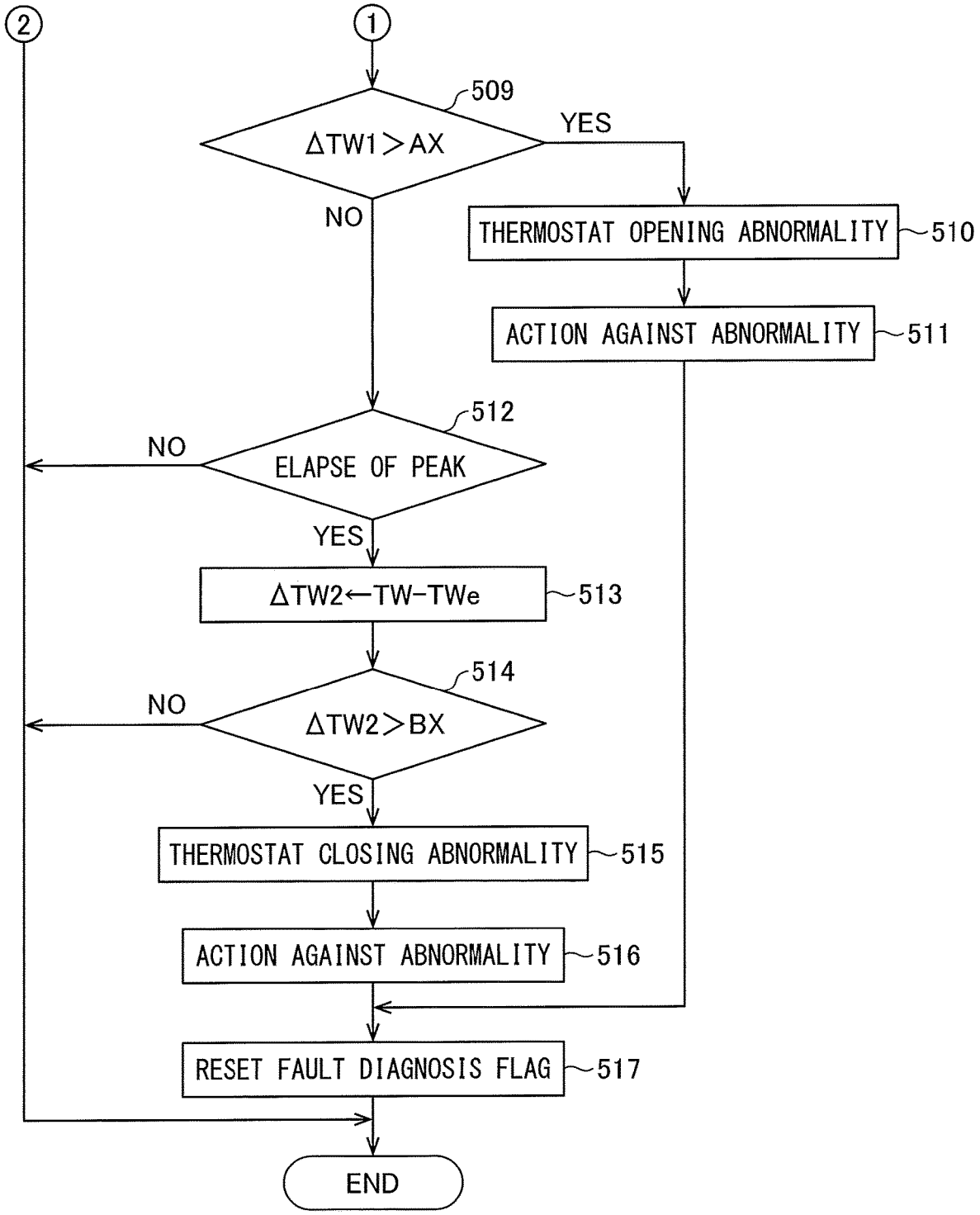
FIG. 24 is a flow chart for fault diagnosis.

FIG. 23 and FIG. 24 show a fault diagnosis routine of a thermostat. This fault diagnosis routine is performed by interruption every fixed time. Note that, to enable easy understanding, this fault diagnosis routine will be explained using the time $t_n$ (n=1, 2, 3 . . . ) shown in FIG. 13. Further, the fixed interruption time of this fault diagnosis routine corresponds to the constant time in FIG. 13 ($t_{n+1}-t_n$). This constant time is, for example, 1 second.

Referring to FIG. 23, first, at step 500, it is judged if the fault diagnosis flag is set. When the fault diagnosis flag is not set, the processing cycle is ended. As opposed to this, when the fault diagnosis flag is set, the routine proceeds to step 501 where whether the state is one where the grille shutter 50 is opened or the state where it is closed is read based on whether a grille shutter opening instruction is issued for making the grille shutter 50 open. Next, at step 502, whether the state is one where the air blown by the blower 63 is circulating through the air-conditioning use heater 65 is read based on the control signal of the electronic control unit provided inside the air-conditioning device 61.

Next, at step 503, a neural network corresponding to the state where the grille shutter 50 is closed and the air blown from the blower 63 is not circulating through the air-conditioning use heater 65, the state where the grille shutter 50 is opened and the air blown from the blower 63 is not circulating through the air-conditioning use heater 65, the state where the grille shutter 50 is closed and the air blown from the blower 63 is circulating through the air-conditioning use heater 65, and the state where the grille shutter 50 is opened and the air blown from the blower 63 is circulating through the air-conditioning use heater 65 is selected from the neural networks 150A, 150B, 150C, and 150D whose weights have finished being learned shown from FIG. 17A to FIG. 17D.

Next, at step 504, the input values $x_1$, $x_2$ . . . $x_{n-1}$, and $x_n$, that is, the engine cooling water temperature TW, the amount of air taken into the engine, the amount of fuel injected into the engine, the outside air temperature, the vehicle speed, the ignition timing, the EGR rate, the opening timing of the exhaust valve 8, and the engine speed are read. Next, at step 505, these input values are input to the nodes of the input layer (L=1) of the selected neural network. If these input values are input to the nodes of the input layer (L=1) of the selected neural network, at step 506, the estimated value "y" of the engine cooling water temperature TW is output from the node of the output layer (L=4) of the selected neural network. Due to this, the estimated value "y" of the engine cooling water temperature TW is acquired. Note that, below, sometimes the estimated value "y" of the engine cooling water temperature TW will be referred to as the "estimated water temperature TWe".

Now then, the time at which the fault diagnosis flag is set and the routine first proceeds to step 501 is shown at the time $t_0$ in FIG. 13. If the engine cooling water temperature TW is used as the input value $x_1$ in FIG. 14, at this time, the measured value of the engine cooling water temperature TW detected by the water temperature sensor 40 is made the input value $x_1$. At this time, the estimated value "y" of the engine cooling water temperature TW at the time $t_1$ of FIG. 13 is output from the node of the output layer (L=4) of the selected neural network. On the other hand, the time at which the routine next proceeds to step 50 is the time $t_1$ after a constant time ($t_{n+1}-t_n$) in FIG. 13. At this time, the estimated value "y" of the engine cooling water temperature TW at the time $t_1$ of FIG. 13 calculated at the previous time of interruption is made the input value $x_1$. At this time, the estimated value "y" of the engine cooling water temperature TW at the time $t_2$ of FIG. 13 is output from the output layer (L=4) of the selected neural network.

Below, in the same way, every time the routine is interrupted, the estimated value "y" of the engine cooling water temperature TW calculated at the time of the previous interruption is made the input value $x_1$. That is, if the fault diagnosis routine of a thermostat is started, as the input value $x_1$, just for the first time, the measured value of the engine cooling water temperature TW is used. After that, the estimated value "y" of the successively calculated engine cooling water temperature TW is used as the input value $x_1$. In this way, the estimated value "y" of the engine cooling water temperature TW after engine startup, that is, the estimated water temperature TWe, is calculated. This estimated water temperature TWe is used for fault diagnosis of a thermostat.

That is, at step 507, it is judged if the estimated water temperature TWe exceeds the engine cooling water temperature TW1 shown in FIG. 7. When the estimated water temperature TWe does not exceed the engine cooling water temperature TW1, the processing cycle ends. As opposed to this, when the estimated water temperature TWe exceeds the engine cooling water temperature TW1, the routine proceeds to step 508 where the difference ΔTW1 (=TWe−TW) between the estimated water temperature TWe and the measured value of the engine cooling water temperature TW is calculated. Next, at step 509, it is judged if the difference ΔTW1 between the estimated water temperature TWe and the measured value of the engine cooling water temperature TW is larger than the predetermined difference AX shown in FIG. 21. When the difference ΔTW1 between the estimated water temperature TWe and the measured value of the engine cooling water temperature TW is larger than the predetermined difference AX, the routine proceeds to step 510 where it is judged that the thermostat 78 is suffering from the valve opening abnormality.

Next, at step 511, an action against abnormalities is taken for when the thermostat 78 is suffering from the valve opening abnormality. As one example of this action against abnormalities, for example, a warning light is turned on. Further, if the thermostat 78 is suffering from the valve opening abnormality, the rate of rise of the engine cooling water temperature TW becomes slower. Therefore, to raise the rate of rise of the engine cooling water temperature TW, as an action against abnormalities, if the grille shutter 50 is opened, the grille shutter 50 can be made to close. Furthermore, to raise the combustion temperature, the ignition timing can be advanced. Next, the routine proceeds to step 517 where the fault diagnosis flag is reset.

On the other hand, when at step 509 it is judged that the difference ΔTW1 between the estimated water temperature TWe and the measured value of the engine cooling water temperature TW is smaller than the predetermined difference AX, the routine proceeds to step 512 where it is judged if the estimated water temperature TWe has exceeded its peak. When it is judged that the estimated water temperature TWe has exceeded its peak, the routine proceeds to step 513 where the difference ΔTW2 (=TW−TWe) between the estimated water temperature TWe and measured value of the engine cooling water temperature TW is calculated. Next, at step 514, it is judged if the difference ΔTW2 between the estimated water temperature TWe and the measured value of the engine cooling water temperature TW is larger than the predetermined difference BX shown in FIG. 21. When the difference ΔTW2 between the estimated water temperature TWe and the measured value of the engine cooling water temperature TW is larger than the predetermined difference BX, the routine proceeds to step 515 whereby it is judged that the thermostat 78 is suffering from the valve closing abnormality. Next, at step 516, an action against abnormalities for when the thermostat 78 is suffering from the valve closing abnormality is performed. For example, a warning light is turned on. Next, the routine proceeds to step 517 where the fault diagnosis flag is reset.

In this way, in the embodiment according to the present invention, the grille shutter 50 able to adjust a flow of running air flowing in from outside of a vehicle to surroundings of the engine body 1, the air-conditioning device 61 having the air-conditioning use heater 65 to which engine cooling water is supplied and the blower 63 blowing air to the air-conditioning use heater 65 to make heated air flow out from the air-conditioning use heater 65, and the engine cooling water recirculation system are provided. This engine cooling water recirculation system is provided with the water pump 27, the main cooling water recirculation passage 74 by which cooling water flowing out from the water pump 27 flows through the water jackets 13 and 14 and the radiator 28 inside the engine body 1 and returns to the water pump 27, the sub cooling water recirculation passage 90 by which cooling water flowing out from the water pump 27 flows through the air-conditioning use heater 65 and returns to the water pump 27, the bypass passage 75 branched from the main cooling water recirculation passage 74 and bypassing the radiator 28, and the thermostat 78 adjusting the flow of cooling water returning from the main cooling water recirculation passage 74 and the bypass passage 75 to the water pump 27. An abnormality of the engine cooling water recirculation system is detected based on the engine cooling water temperature. Four learned neural networks 150A, 150B, 150C, and 150D are stored using at least the five parameters comprised of an engine cooling water temperature at the time of engine start, an amount of air taken into the engine, an amount of fuel injected into the engine, an outside air temperature, and a vehicle speed as input parameters of the neural networks, using a measured value of the engine cooling water temperature as training data, and learning weights for the four states comprising a state where the grille shutter 50 is closed and the air blown by the blower 62 does not circulate through the air-conditioning use heater 65, a state where the grille shutter 50 is opened and the air blown by the blower 63 does not circulate through the air-conditioning use heater 65, a state where the grille shutter 50 is closed and the air blown by the blower 62 circulates through the air-conditioning use heater 65, and a state where the grille shutter 50 is opened and the air blown by the blower 63 circulates through the air-conditioning use heater 65. The engine cooling water temperature is estimated from among the above-mentioned five parameters using any one of the learned neural networks corresponding to the current state of the grille shutter 50 and the circulating state of the air blown by the blower 63 in the air-conditioning use heater 65 among the four learned neural networks 150A, 150B, 150C, and 150D. An abnormality of the engine cooling water recirculation system is detected based on the estimated value of the engine cooling water temperature.

Figure 25:
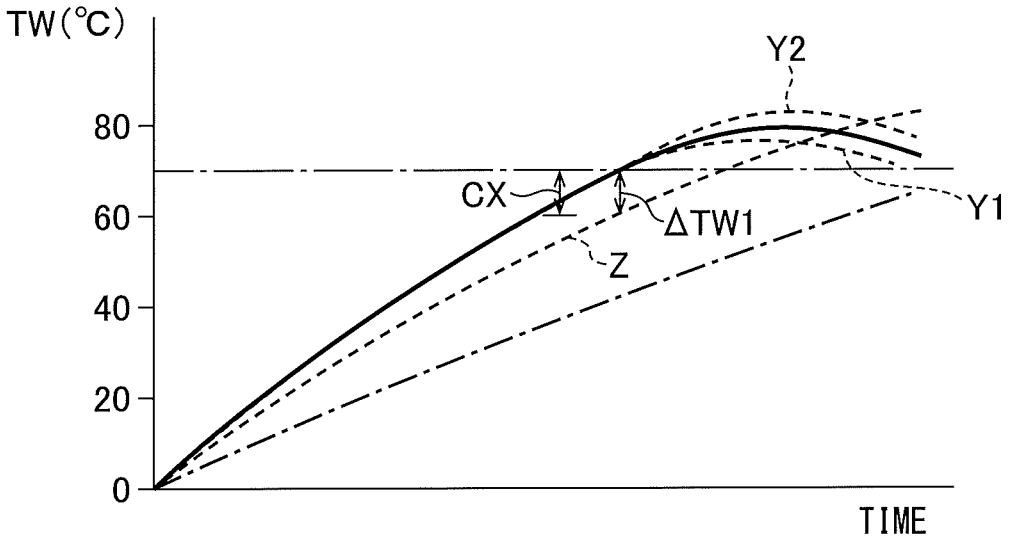
FIG. 25 is a view showing changes in the engine cooling water temperature.

Next, referring to FIG. 25, the method of fault diagnosis of the thermostat 78 and multifunctional valve 91 performed at a commercially available vehicle will be explained. FIG. 25 shows the change of the engine cooling water temperature TW at the time of engine start. Note that, as was already explained while referring to FIG. 7, when the cooling water temperature TW is lower than the set water temperature TW2, the multifunctional valve 91 is closed. On the other hand, when the cooling water temperature TW is higher than the set water temperature TW2, if the EGR control valve 25 closes, the multifunctional valve 91 is also made to close, while if the EGR control valve 25 opens, the multifunctional valve 91 also is made to open.

Referring to FIG. 25, the solid line shows when the thermostat 78 and multifunctional valve 91 are operating normally at a certain operating state. On the other hand, the broken line Y1 shows when the multifunctional valve 91 continues to be made to close even after the cooling water temperature TW becomes higher than the set water temperature TW2, while the broken line Y2 shows when the multifunctional valve 91 continues to be made to open after the cooling water temperature TW becomes higher than the set water temperature TW2. When the cooling water temperature TW becomes higher than the set water temperature TW2, the EGR control valve 25, the EGR cooler 26 and the exhaust heat collector 23 become higher in temperature. Therefore, at this time, the cooling water made to circulate through the sub cooling water recirculation passage parts 90B and 90C receives heat from the EGR control valve 25, the EGR cooler 26 and the exhaust heat collector 23 and rises in temperature.

Therefore, if, after the cooling water temperature TW becomes higher than the set water temperature TW2, the multifunctional valve 91 continues to be made to open, the amount of cooling water receiving heat from the EGR control valve 25, the EGR cooler 26 and the exhaust heat collector 23 and rising in temperature increases. Therefore, if, after the cooling water temperature TW becomes higher than the set water temperature TW2, the multifunctional valve 91 continues to be made to open, as shown by the broken line Y2, the temperature of the engine cooling water temperature TW becomes somewhat higher compared with when the multifunctional valve 91 is closed (shown by the broken line Y1).

On the other hand, the broken line Z shows when the multifunctional valve 91 suffers from a valve opening abnormality continuing to be opened from the time of engine start in case where the thermostat 78 is normal. Further, the dash dot line shows the time when the multifunctional valve 91 is normal, but the thermostat 78 suffers from the valve opening abnormality. Now, at the time of engine start, the temperatures of the EGR cooler 26 and the exhaust heat collector 23 are low, so after engine startup, if increasing the amount of cooling water circulating through the sub cooling water recirculation passage parts 90B and 90C, heat of the cooling water will be robbed for heating the EGR cooler 26 and the exhaust heat collector 23 and a rise in temperature of the cooling water is suppressed. Therefore, if the multifunctional valve 91 suffers from the valve opening abnormality continuing to be opened from the time of engine start, the amount of cooling water made to circulate from right after engine startup through the sub cooling water recirculation passage parts 90B and 90C is made to increase, so a rise in temperature of the cooling water is suppressed. As a result, the engine cooling water temperature TW, as shown by the broken line Z, rises faster than when the thermostat 78 suffers from the valve opening abnormality, but slowly rises if compared with when the thermostat 78 is normal.

If in this way the multifunctional valve 91 suffers from the valve opening abnormality, the way the engine cooling water temperature TW changes after engine startup differs from that at normal times. Therefore, if comparing the way the measured engine cooling water temperature TW changes and the way the engine cooling water temperature TW at normal times changes, it becomes possible to judge if the multifunctional valve 91 is suffering from the valve opening abnormality. On the other hand, when the multifunctional valve 91 suffers from a valve closing abnormality continuing to be closed, the temperature of the engine cooling water temperature TW changes as shown by the broken line Y1 after the cooling water temperature TW becomes higher than the set water temperature TW2. Therefore, when the multifunctional valve 91 continues to be closed after the cooling water temperature TW becomes higher than the set water temperature TW2, it would appear to be possible to detect that the multifunctional valve 91 suffers from the valve closing abnormality from the difference between the temperature of the engine cooling water temperature TW shown by the broken line Y1 and the temperature of the engine cooling water temperature TW shown by the broken line Y2 at that time.

However, the difference between the temperature of the engine cooling water temperature TW shown by the broken line Y1 and the temperature of the engine cooling water temperature TW shown by the broken line Y2 is small. Further, the temperature of the engine cooling water temperature TW shown by the broken line Y1 and the temperature of the engine cooling water temperature TW shown by the broken line Y2 also fluctuate due to factors other than the opened/closed state of the multifunctional valve 91, so it is difficult to detect the valve closing abnormality of the multifunctional valve 91 from the difference between the temperature of the engine cooling water temperature TW shown by the broken line Y1 and the temperature of the engine cooling water temperature TW shown by the broken line Y2.

As opposed to this, when the multifunctional valve 91 suffers from the valve opening abnormality, as explained above, it is possible to judge whether the multifunctional valve 91 suffers from the valve opening abnormality from the way the engine cooling water temperature TW changes after engine startup. Therefore, in the embodiment according to the present invention, the valve opening abnormality of the multifunctional valve 91 is detected from the way the engine cooling water temperature TW changes after engine startup, and the valve closing abnormality of the multifunctional valve 91 is detected by another method explained later.

Explaining a specific example performed in the embodiment of the present invention for detecting the valve opening abnormality of the multifunctional valve 91, as shown in FIG. 25, when the estimated value of the engine cooling water temperature TW shown by the solid line reaches the valve opening temperature of the thermostat 78, for example, 70° C., if the difference ΔTW1 of the estimated value of the engine cooling water temperature TW minus the measured value of the engine cooling water temperature TW is smaller than the predetermined difference AX (FIG. 21) and larger than a predetermined difference CX, it is judged that the multifunctional valve 91 suffers from the valve opening abnormality.

That is, in this embodiment according to the present invention, when after engine startup, the amount of rise of the measured value of the engine cooling water temperature is lower compared with the amount of rise of the estimated value of the engine cooling water temperature, it is judged that the abnormality of operation of the thermostat 78 has occurred in which cooling water continues to circulate from the main cooling water recirculation passage 74 toward the water pump 27 while when after engine startup, the amount of rise of the measured value of the engine cooling water is lower than the amount of rise of the estimated value of the engine cooling water and the amount of rise of the measured value of the engine cooling water temperature is higher compared with the amount of rise of the measured value of the engine cooling water temperature when the abnormality of operation of the thermostat 78 occurs, it is judged that the abnormality of operation of the multifunctional valve 91 occurs in which the multifunctional valve 91 continues opened.

Figure 26:
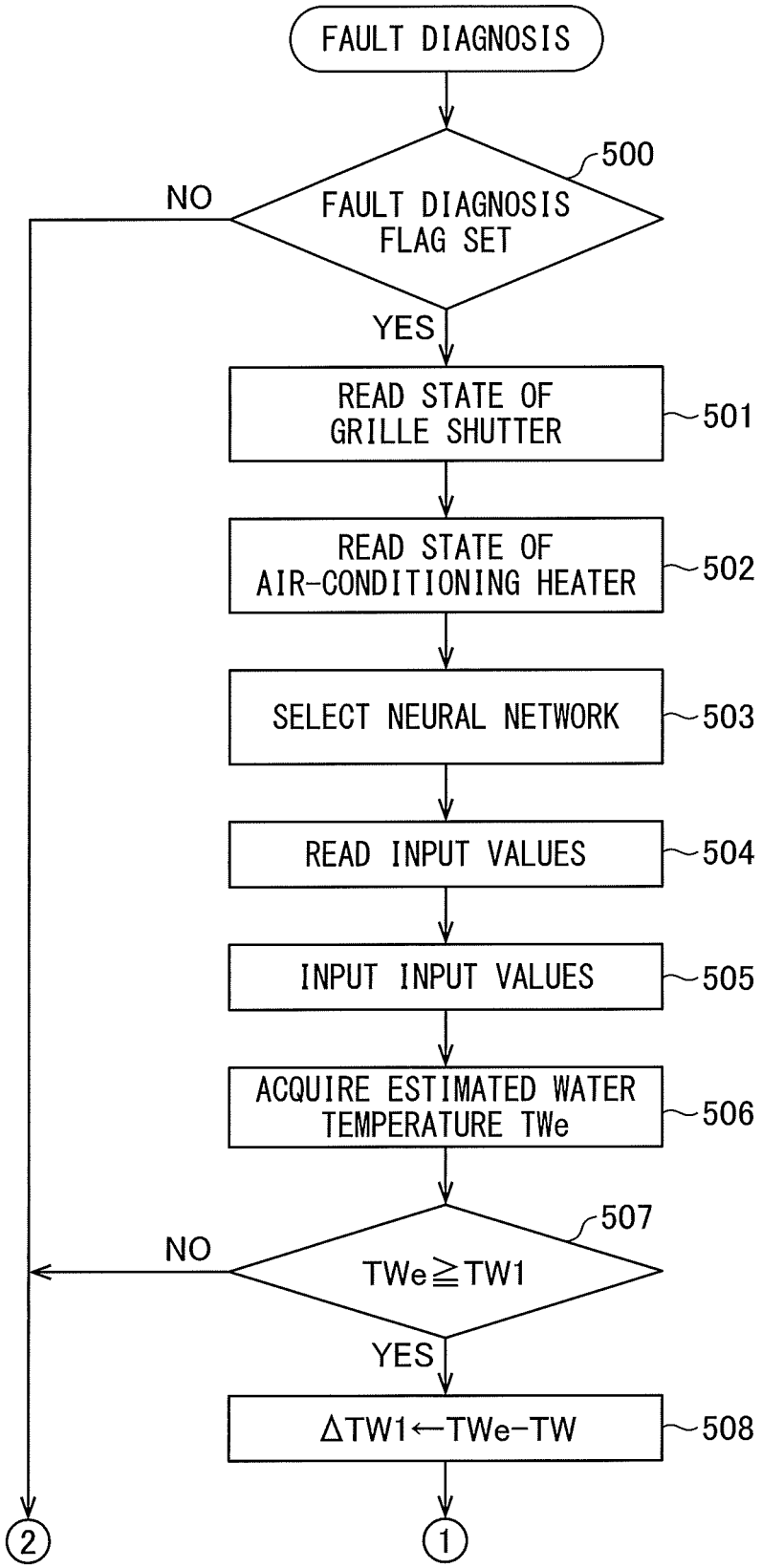
FIG. 26 is a flow chart for fault diagnosis.
Figure 27:
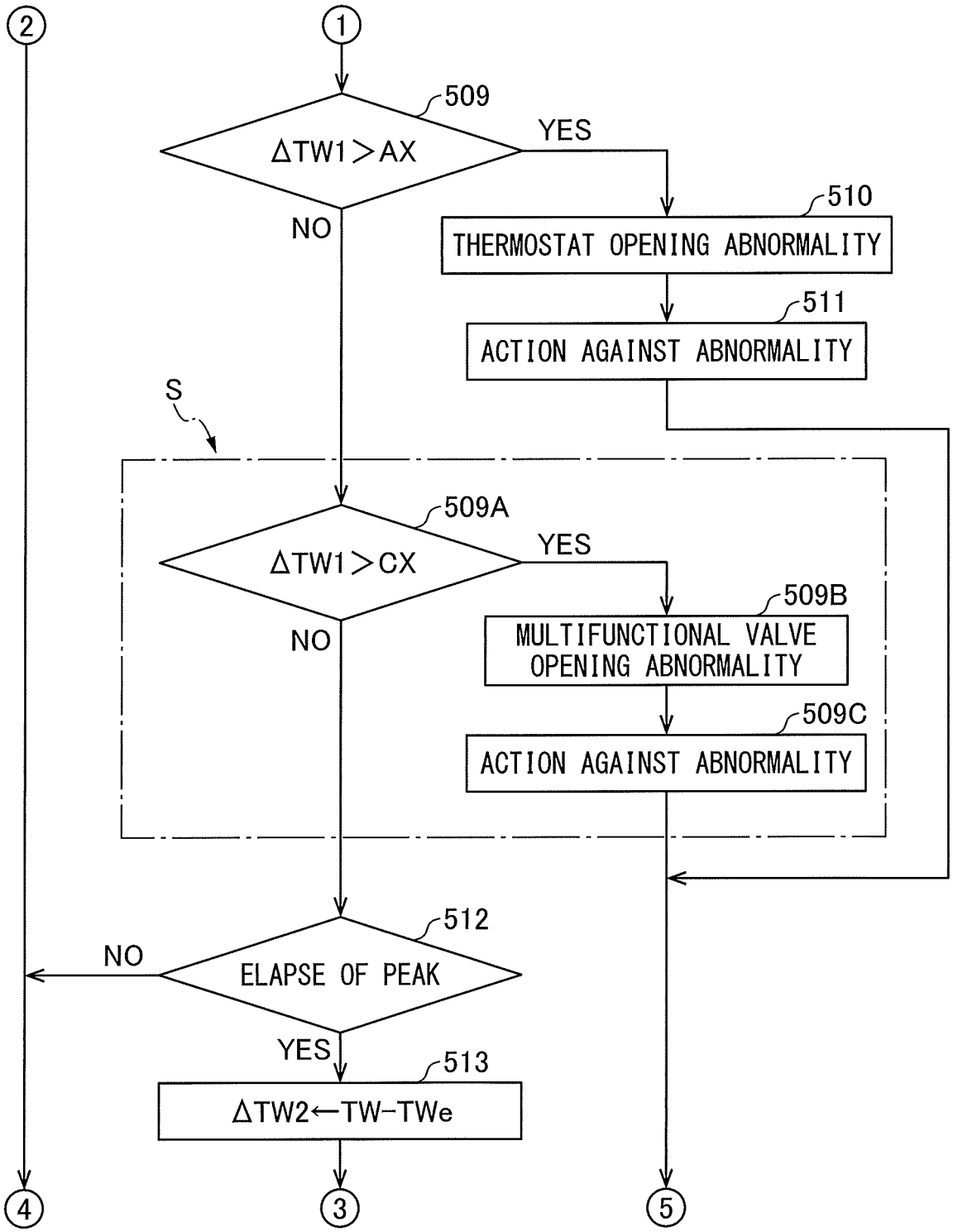
FIG. 27 is a flow chart for fault diagnosis.
Figure 28:
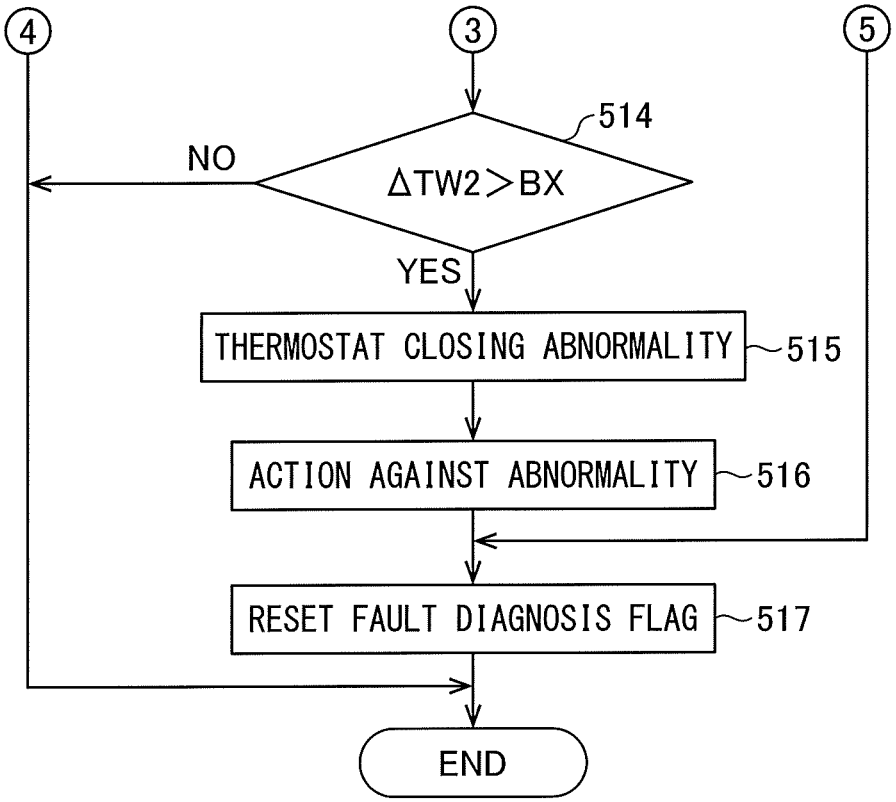
FIG. 28 is a flow chart for fault diagnosis.

FIG. 26 to FIG. 28 show a fault diagnosis routine for detecting the valve opening abnormality and the valve closing abnormality of the thermostat and the valve opening abnormality of the multifunctional valve. This fault diagnosis routine, in the same way as the fault diagnosis routine shown in FIG. 23 and FIG. 24, is performed by interruption every fixed time. Note that, the fault diagnosis routine shown from FIG. 26 to FIG. 28 is comprised of the fault diagnosis routine shown in FIG. 23 and FIG. 24 to which the three steps 509A, 509B, and 509C in the space S surrounded by the dash dot line in FIG. 27 are added. The other steps 500 to 517 are completely the same as steps 500 to 517 of the fault diagnosis routine shown in FIG. 23 and FIG. 24. Therefore, in the explanation of the fault diagnosis routine shown from FIG. 26 to FIG. 28, explanation of steps 500 to 517 will be omitted. Only the three steps 509A, 509B, and 509C in the space S of FIG. 27 will be explained.

That is, referring to FIG. 27, at step 509A, it is judged if the difference ΔTW1 between the estimated water temperature TWe and the measured value of the engine cooling water temperature TW is larger than the preset difference CX shown in FIG. 25. When the difference ΔTW1 between the estimated water temperature TWe and the measured value of the engine cooling water temperature TW is larger than the preset difference CX, that is, if considering step 509, when the difference ΔTW1 between the estimated water temperature TWe and the measured value of the engine cooling water temperature TW is smaller than the preset difference AX (FIG. 21) and larger than the preset difference CX, the routine proceeds to step 509B where it is judged that the valve opening abnormality occurs in the multifunctional valve 91.

Next, at step 509C, the action against abnormalities when the multifunctional valve 91 suffers from the valve opening abnormality is performed. As one example of this action against abnormalities, for example, a warning light is turned on. Next, the routine proceeds to step 517. On the other hand, at step 509A, when it is judged that the difference ΔTW1 between the estimated water temperature TWe and the measured value of the engine cooling water temperature TW is smaller than the preset difference CX, the routine proceeds to step 512.

Next, the method of detecting when the multifunctional valve 91 suffers from the valve closing abnormality will be explained. As explained above, the difference between the engine cooling water temperature TW shown by the broken line Y1 and the engine cooling water temperature TW shown by the broken line Y2 in FIG. 25 is small. Further, the engine cooling water temperature TW shown by the broken line Y1 and the engine cooling water temperature TW shown by the broken line Y2 both fluctuate due to factors other than the opened/closed state of the multifunctional valve 91, so it is difficult to detect the valve closing abnormality of the multifunctional valve 91 from the difference between the engine cooling water temperature TW shown by the broken line Y1 and the engine cooling water temperature TW shown by the broken line Y2. Therefore, in the embodiment according to the present invention, the valve closing abnormality of the multifunctional valve 91 is detected from the change in the engine cooling water temperature TW when an instruction for opening is issued to the multifunctional valve 91 or when an instruction for closing is issued to the multifunctional valve 91.

Figure 29:
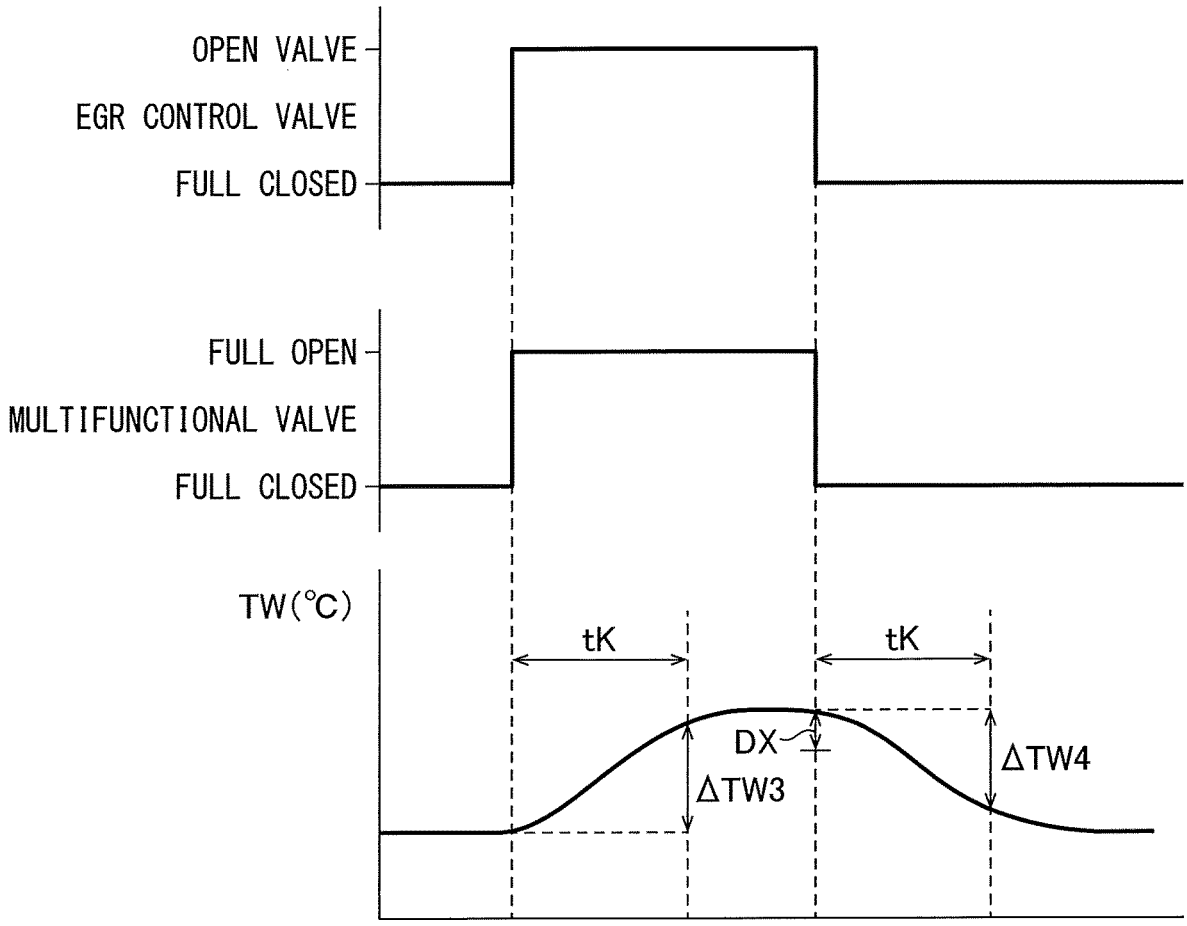
FIG. 29 is a view showing changes in the engine cooling water temperature.

Next, this will be explained while referring to FIG. 29. FIG. 29 shows the changes in state of the EGR control valve 25, the state of the multifunctional valve 91, and the engine cooling water temperature TW. As shown in FIG. 29, if the EGR control valve 25 is opened, an instruction for opening the multifunctional valve 91 is issued whereby the multifunctional valve 91 is made to open. Further, as shown in FIG. 29, if EGR control valve 25 is closed, an instruction for closing the multifunctional valve 91 is issued whereby the multifunctional valve 91 is made closed. On the other hand, for example, when the engine cooling water temperature TW exceeds 70° C., it is judged that the engine has finished being warmed up. After the engine has finished being warmed up, the cooling water made to circulate through the sub cooling water recirculation passage parts 90B and 90C receives heat from the EGR control valve 25 and the EGR cooler 26 and exhaust heat collector 23 and rises in temperature.

Therefore, as shown in FIG. 29, when the multifunctional valve 91 is opened, the engine cooling water temperature TW rises, while the multifunctional valve 91 is closed, the engine cooling water temperature TW falls. Therefore, it is possible to detect whether the multifunctional valve 91 suffers from the valve closing abnormality from a change in the engine cooling water temperature TW when the multifunctional valve 91 opens or closes. Therefore, in the embodiment according to the present invention, as shown in FIG. 29, when the amount of temperature rise ΔTW3 when a constant time tk has elapsed from when an instruction for opening the multifunctional valve 91 is issued is smaller than a predetermined value DX, it is judged that the multifunctional valve 91 suffers from the valve closing abnormality. Furthermore, as shown in FIG. 29, when the amount of temperature drop ΔTW4 when a constant time tk has elapsed from when an instruction for closing the multifunctional valve 91 is issued is smaller than the predetermined value DX, it is judged that the multifunctional valve 91 suffers from the valve closing abnormality.

That is, in the embodiment according to the present invention, when the EGR control valve 25 is opened, the multifunctional valve 91 is opened and when the EGR control valve 25 is closed, the multifunctional valve 91 is closed. When the EGR control valve 25 changes from a closed state to an opened state, if the amount of rise of the estimated value of the engine cooling water temperature is the predetermined amount or less, it is judged that an abnormality in operation of the multifunctional valve 91 occurs where the multifunctional valve 91 continues closed.

Figure 30:
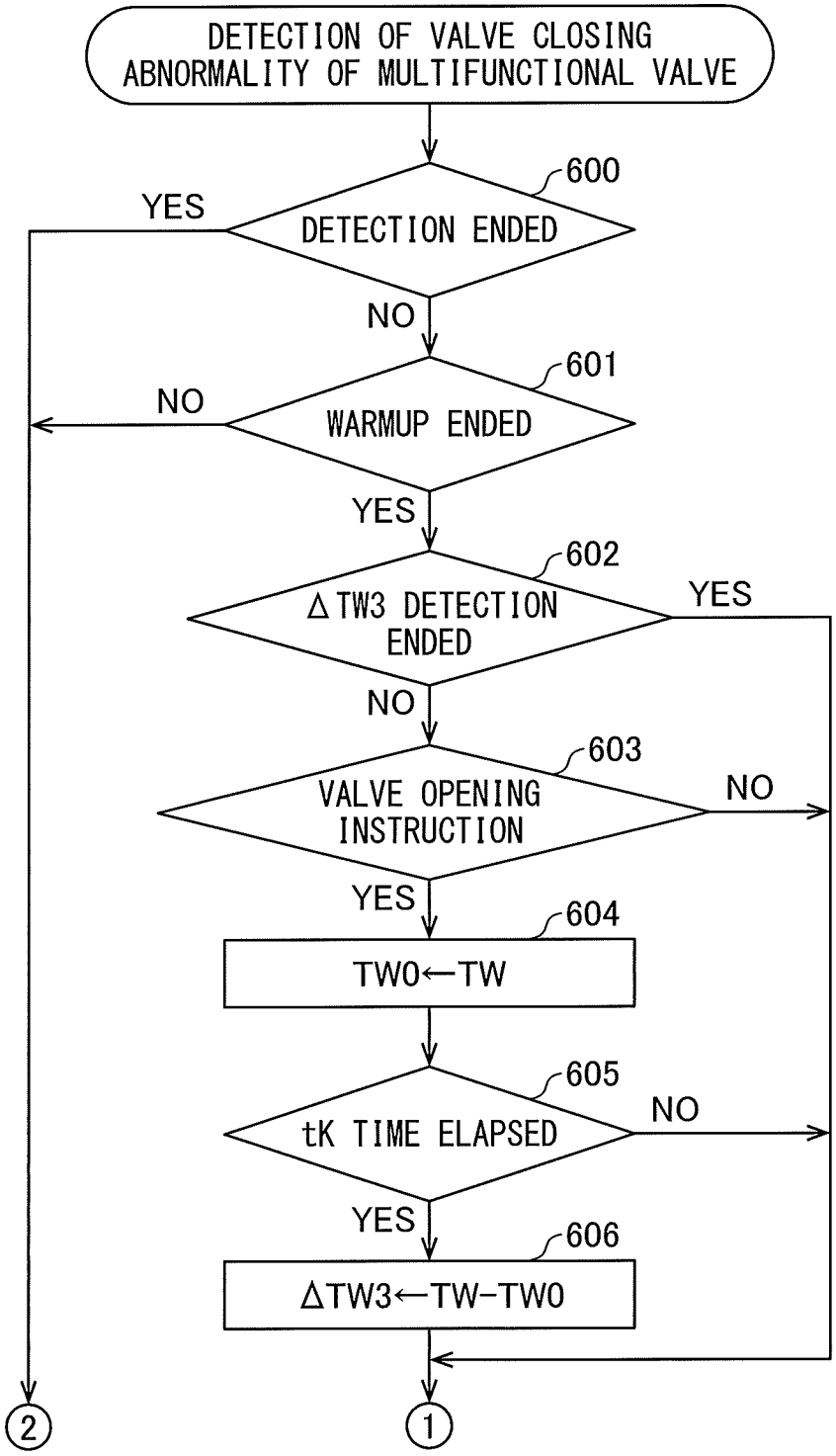
FIG. 30 is a flow chart for detecting a valve closing abnormality of a multifunctional valve.
Figure 31:
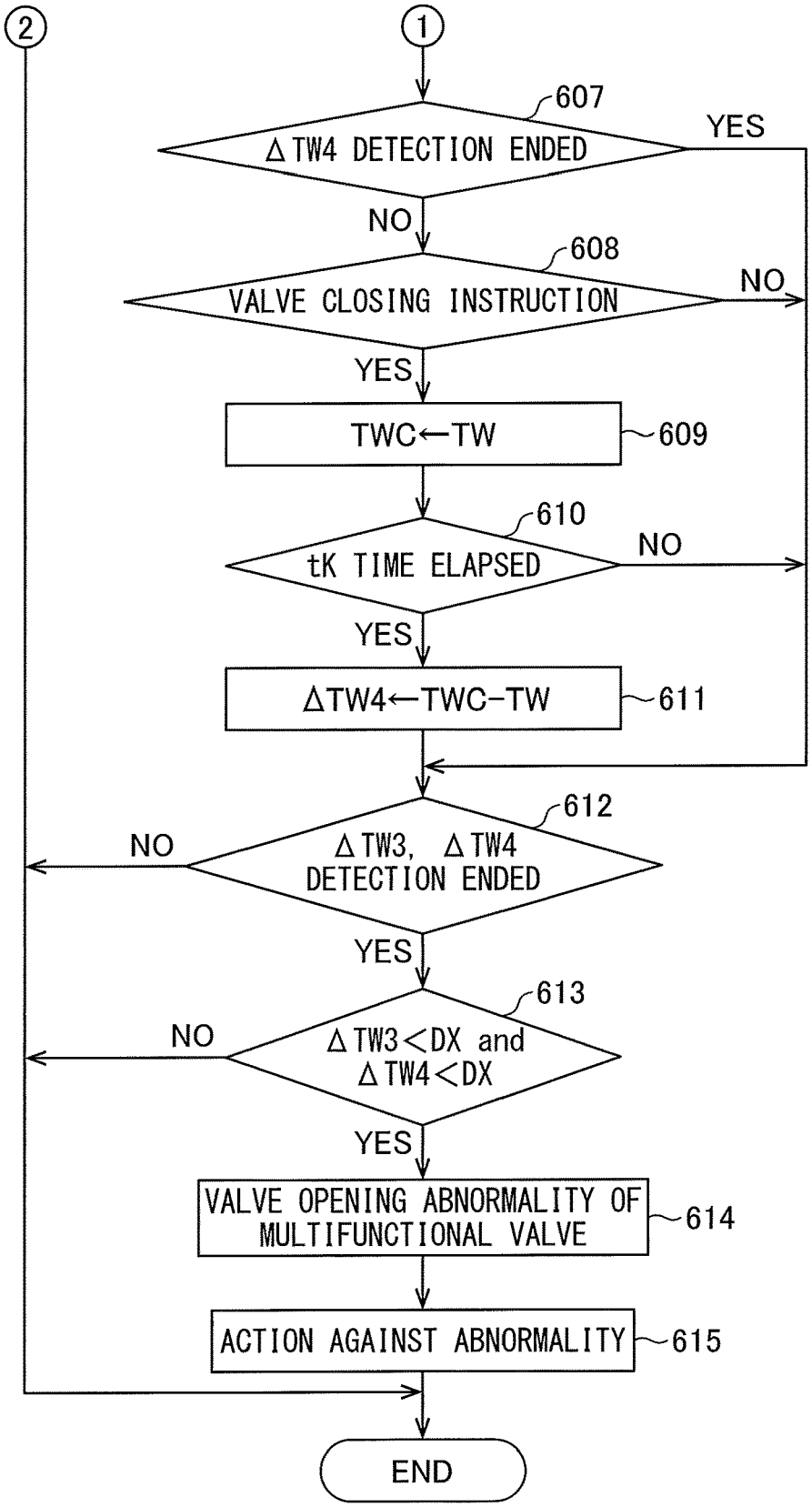
FIG. 31 is a flow chart for detecting a valve closing abnormality of a multifunctional valve.

FIG. 30 and FIG. 31 show a routine for detecting the valve closing abnormality of the multifunctional valve 91. This routine is performed by interruption every fixed time. Referring to FIG. 30, first, at step 600, it is judged if the valve closing abnormality of the multifunctional valve 91 has finished being detected. When the valve closing abnormality of the multifunctional valve 91 has finished being detected, the processing cycle is ended. As opposed to this, when the valve closing abnormality of the multifunctional valve 91 has not finished being detected, the routine proceeds to step 601 where it is judged if the engine has finished being warmed up. When the engine has not finished being warmed up, the processing cycle is ended. As opposed to this, when the engine has finished being warmed up, the routine proceeds to step 602.

At step 602, it is judged if the amount of temperature rise ΔTW3 shown in FIG. 29 has finished being detected. When the amount of temperature rise ΔTW3 has finished being detected, the routine jumps to step 607. As opposed to this, if the amount of temperature rise ΔTW3 has not finished being detected, the routine proceeds to step 603 where it is judged if an instruction for opening the multifunctional valve 91 is issued. When an instruction for opening the multifunctional valve 91 is not issued, the routine jumps to step 607. As opposed to this, when an instruction for opening the multifunctional valve 91 is issued, the routine proceeds to step 604 where the engine cooling water temperature TW at that time is made the water temperature TWO. Next, at step 605, it is judged if a constant time tk shown in FIG. 29 has elapsed. When the constant time tk has not elapsed, the routine jumps to step 607. As opposed to this, when the constant time tk has elapsed, the routine proceeds to step 606 where the water temperature TWO is subtracted from the engine cooling water temperature TW at that time whereby the amount of temperature rise ΔTW3 is calculated. Next, the routine proceeds to step 607.

At step 607, it is judged if the amount of temperature rise ΔTW4 shown in FIG. 29 has finished being detected. When the amount of temperature rise ΔTW4 has finished being detected, the routine jumps to step 612. As opposed to this, when the amount of temperature rise ΔTW4 has not finished being detected, the routine proceeds to step 608 where it is judged if an instruction for closing the multifunctional valve 91 is issued. When an instruction for closing the multifunctional valve 91 is not issued, the routine jumps to step 612. As opposed to this, when an instruction for closing the multifunctional valve 91 is issued, the routine proceeds to step 609 where the engine cooling water temperature TW at that time is made the water temperature TWC. Next, at step 610, it is judged if the constant time tk shown in FIG. 29 has elapsed. When the constant time tk has not elapsed, the routine jumps to step 612. As opposed to this, when the constant time tk has elapsed, the routine proceeds to step 611 where the engine cooling water temperature TW at that time is subtracted from the water temperature TWC whereby the amount of temperature drop ΔTW4 is calculated. Next, the routine proceeds to step 612.

At step 612, it is judged if the amount of temperature rise ΔTW3 and the amount of temperature drop ΔTW4 have finished being detected. When the amount of temperature rise ΔTW3 and the amount of temperature drop ΔTW4 have finished being detected, the routine proceeds to step 613 where it is judged if amount of temperature rise ΔTW3 is smaller than the predetermined value DX shown in FIG. 29 and if the amount of temperature drop ΔTW4 is smaller than the predetermined value DX shown in FIG. 29. When the amount of temperature rise ΔTW3 is smaller than the predetermined value DX and the amount of temperature drop ΔTW4 is smaller than the predetermined value DX, the routine proceeds to step 614 where it is judged if the multifunctional valve 91 suffers from the valve closing abnormality. Next, at step 615, an action against abnormalities taken when the multifunctional valve 91 suffers from the valve closing abnormality is performed. As one example of this action against abnormalities, for example, a warning light is turned on.

The invention claimed is:

1. An abnormality detection system of an engine cooling water recirculation system comprising:

a grille shutter able to adjust a flow of running air flowing in from outside of a vehicle to surroundings of an engine body, an air-conditioning device having an air-conditioning use heater to which engine cooling water is supplied and a blower blowing air to the air-conditioning use heater to make heated air flow out from the air-conditioning use heater, and an engine cooling water recirculation system, said engine cooling water recirculation system comprising a water pump, a main cooling water recirculation passage by which cooling water flowing out from the water pump returns to the water pump through a water jacket and radiator in the engine body, a sub cooling water recirculation passage by which cooling water flowing out from the water pump returns to the water pump through the air-conditioning use heater, a bypass passage branched from the main cooling water recirculation passage and bypassing the radiator, and a thermostat adjusting a flow of cooling water returning from the main cooling water recirculation passage and bypass passage to the water pump, an abnormality in the engine cooling water recirculation system being detected based on an engine cooling water temperature, wherein four learned neural networks are stored on a non-transitory computer-readable storage medium, which are obtained by using at least five parameters comprised of an engine cooling water temperature at the time of engine start, an amount of air taken into the engine, an amount of fuel injected into the engine, an outside air temperature, and a vehicle speed as input parameters of the neural networks and using a measured value of the engine cooling water temperature as training data to learn weights for four states comprising a state where the grille shutter is closed and an air blown by the blower does not circulate through the air-conditioning use heater, a state where the grille shutter is opened and the air blown by the blower does not circulate through the air-conditioning use heater, a state where the grille shutter is closed and the air blown by the blower circulates through the air-conditioning use heater, and a state where the grille shutter is opened and the air blown by the blower circulates through the air-conditioning use heater, the engine cooling water temperature is estimated from among said five parameters using any one of the learned neural networks corresponding to a current state of the grille shutter and circulating state of the air blown by the blower in the air-conditioning use heater among the four learned neural networks, and an abnormality of the engine cooling water recirculation system is detected based on an estimated value of the engine cooling water temperature.

2. The abnormality detection system of an engine cooling water recirculation system according to claim 1, wherein when, after engine startup, an amount of rise of the measured value of the engine cooling water temperature is lower compared to an amount of rise of the estimated value of the engine cooling water temperature, it is judged that an abnormality in operation of the thermostat occurs in which cooling water is continuing to flow from the main cooling water recirculation passage toward the water pump.

3. The abnormality detection system of an engine cooling water recirculation system according to claim 1, wherein when, after engine startup, an amount of rise of the measured value of the engine cooling water temperature is higher compared to an amount of rise of the estimated value of the engine cooling water temperature, it is judged that an abnormality in operation of the thermostat occurs in which cooling water continues stopped from flowing from the main cooling water recirculation passage toward the water pump.

4. The abnormality detection system of an engine cooling water recirculation system according to claim 1, wherein in addition to said five parameters, an ignition timing, EGR rate, opening timing of exhaust valve, and engine speed are made input parameters of the neural networks.

5. The abnormality detection system of an engine cooling water recirculation system according to claim f, wherein cooling water flowing through the sub cooling water recirculation passage is supplied to an EGR cooler, the cooling water flowing ort from a water jacket inside the engine body is supplied through a multifunctional valve to the sub cooling water recirculation passage upstream of the EGR cooler, when, after engine startup, an amount of rise of the measured value of the engine cooling water temperature is lower than an amount of rise of the estimated value of the engine cooling water temperature, it is judged that an abnormality in operation of the thermostat occurs in which the cooling water is continuing to flow from the main cooling water recirculation passage toward the water pump, and when after engine startup, the amount of rise of the measured value of the engine cooling water is lower than the amount of rise of the estimated value of the engine cooling water and the amount of rise of the measured value of the engine cooling water temperature is higher compared with the amount of rise of the measured value of the engine cooling water temperature when an abnormality of operation of the thermostat occurs, it is judged that an abnormality of operation of the multifunctional valve occurs in which the multifunctional valve continues opened.

6. The abnormality detection system of an engine cooling water recirculation system according to claim 5, wherein when the EGR control valve is opened, the multifunctional valve is opened, when the EGR control valve is closed, the multifunctional valve is closed, and when the EGR control valve changes from a closed state to an opened state, if the amount of rise of the estimated value of the engine cooling water temperature is a predetermined amount or less, it is judged that an abnormality ire operation of the multifunctional valve occurs in which the multifunctional valve continues closed.

* * * * *